US008687990B2

(12) United States Patent
Suzuki et al.

(10) Patent No.: US 8,687,990 B2
(45) Date of Patent: Apr. 1, 2014

(54) IMAGE FORMING APPARATUS

(75) Inventors: Akimichi Suzuki, Yokohama (JP); Atsushi Murakami, Kawasaki (JP); Terutaka Endo, Odawara (JP); Hisayuki Tomura, Izunokuni (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/448,694

(22) Filed: Apr. 17, 2012

(65) Prior Publication Data

US 2012/0269531 A1 Oct. 25, 2012

(30) Foreign Application Priority Data

Apr. 20, 2011 (JP) ..... 2011-094021

(51) Int. Cl.
*G03G 15/20* (2006.01)

(52) U.S. Cl.
USPC ..... 399/68

(58) Field of Classification Search
USPC ..... 399/66, 67, 68, 316, 384
See application file for complete search history.

(56) References Cited

U.S. PATENT DOCUMENTS 4,928,141 A * 5/1990 Poehlein et al. ..... 399/68
2009/0324305 A1 * 12/2009 Udaka et al. ..... 399/302

FOREIGN PATENT DOCUMENTS

JP 2005-115075 A 4/2005
JP 2006-309189 A 11/2006
JP 2008-122512 A 5/2008
JP 2008-233196 A 10/2008

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus includes a rotatable image carrying member, a rotatable transfer member cooperative with the image carrying member, and a fixing unit having a fixing nip for nipping and feeding the recording material discharged from the transfer nip while fixing the toner image. In addition, a bowing amount measuring unit measures a bowing amount of the recording material, a storing portion stores a target bowing amount, and a speed controller controls a feeding speed of the recording material. The storing portion stores a plurality of target bowing amounts, which are selectable depending on kinds of the recording material, and the speed controller controls the feeding speed in the fixing nip, and then controls the feeding speed so that the bowing amount is substantially zero at the time when a trailing edge of the recording material leaves the transfer nip.

18 Claims, 15 Drawing Sheets

IMAGE FORMING APPARATUS

FIELD OF THE INVENTION AND RELATED ART

The present invention relates to an image forming apparatus such as a copying machine, a laser beam printer, and the like.

Recently, a demand for an image forming apparatus outputting a borderless print has been increasing. The conventional method for obtaining a borderless print is to print an image on a sheet of transfer medium (recording medium) which is slightly larger than the image, and then, to trim away the edge portions of the sheet, which were not covered with the image. In other words, this method requires an operation for trimming away the edge portions of the sheet P. In recent years, therefore, a demand has been increasing for an image forming apparatus capable of outputting a borderless print without leaving margins along the edges of a sheet of recording medium, that is, an image forming apparatus capable of covering the entirety of a sheet of recording medium with an image in order to eliminate the trimming operation.

There is proposed an image forming apparatus capable of operating in the so-called borderless printing mode in Japanese Laid-open Patent Application 2008-122512. According to this patent application, a borderless print is obtained by forming a toner image, which is slightly larger than a sheet of recording medium, on the peripheral surface of a photosensitive drum, and then, transferring the toner image onto the sheet of recording means.

It is possible that when a sheet of recording medium is conveyed through the transfer nip, the sheet P will become askew, and/or will change in position relative to the transfer roller in terms of the lengthwise direction of the transfer roller. However, the use of the above-described method for outputting a borderless print makes it possible to form an excellent borderless image on a sheet of recording medium even if a sheet of recording medium becomes askew and/or changes in position as described above.

However, if the trailing end portion of a sheet of recording medium reduces in speed in the transfer nip while a borderless print is made, the so-called "tail end smear" sometimes occurs; the portion of the toner image, which is being transferred from the photosensitive drum onto the sheet of recording medium is sometimes disturbed.

Next, the "tail end smear" is described with reference to FIGS. 16 and 17. First, referring to FIG. 16, designated by a referential code 205 is an electrophotographic photosensitive drum, as a toner image bearing member, on which an electrostatic latent image is formed. The drum 205 is rotated in the clockwise direction indicated by an arrow mark at a preset peripheral velocity. As the photosensitive drum 205 is rotated, a toner image, which reflects the information of the image to be formed, is formed on the peripheral surface of the photosensitive drum 205 by electrophotographic processing devices (not shown). The image forming apparatus 200 is provided with transfer roller 209, as a transferring means, which is in contact with the drum 205. The roller 209 is rotated by the rotation of the drum 205. The area of contact between the drum 205 and roller 209 is the transfer nip T.

A sheet P of recording medium (which hereafter may be referred to as transfer medium) is introduced into the transfer nip T, and is conveyed through the nip T while remaining pinched between the drum 205 and roller 209. As the transfer sheet P is conveyed through the nip T, the toner image on the drum 205 is transferred onto the transfer sheet P as if it is peeled away from the drum 205. As the transfer sheet P is conveyed out of the nip T, it is separated from the drum 205. Then, it is conveyed to a fixing device 233 along a guiding member 232. The fixing device 233 is on the downstream side of the nip T in terms of the transfer medium conveyance direction. Then, the transfer sheet P is introduced into the fixation nip F which the rotational fixation roller 210 (fixation roller) and rotational pressure roller 211 (pressure roller) form. Then, the sheet P is conveyed through the fixation nip F while remaining pinched between the rollers 201 and 211. While the transfer sheet P is conveyed through the fixation nip F, the unfixed toner image on the transfer sheet P is fixed to the transfer sheet P.

The transfer sheet P is conveyed from the transfer nip T to the fixation nip F in such a manner that when the leading edge of the transfer sheet P begins to be conveyed through the fixation nip F, the trailing end portion of the transfer sheet P is still in the transfer nip T, and that when the trailing edge of the transfer sheet P comes out of the transfer nip T, the transfer sheet P is still in the fixation nip F. The image forming apparatus 200 is controlled so that while the transfer sheet P is conveyed between the transfer nip T and fixation nip F as described above (with its leading and trailing end portions remaining pinched by transfer nip T and fixation nip F, respectively), the transfer sheet P remains bowed, as indicated by a solid line in FIG. 16, by a preset amount, in order to prevent the image forming apparatus 200 from outputting a print suffering from defects attributable to the problem that the transfer sheet P is excessively pulled by the fixation nip F.

Referring again to FIGS. 16 and 17, the state of the transfer sheet P, in which the transfer sheet P is being conveyed while remaining pinched by both the transfer nip T and fixation nip F, and also, in which the transfer sheet P is bowing downward (sagging) by a preset amount d is referred to as a state A (indicated by solid line in FIG. 16). A referential mode L0 stands for the distance of the path of the transfer sheet P from the exit of the transfer nip T to the entrance of the fixation nip F when the transfer sheet P is in the state B. Further, the state of the transfer sheet P, in which the amount d of the bow of the transfer sheet P is zero, that is, the state of the transfer sheet P, in which the transfer sheet P is remaining tightly stretched, being therefore flat, is referred to as a state B (indicated by dotted line in FIG. 16). Further, a referential code L0 stands for the distance of the path of the transfer sheet P when the transfer sheet P is in the state B.

However, as long as the image forming apparatus 200 is controlled in the amount of the bow of the transfer sheet P so that the transfer sheet P remains in the state A, an image defect, more specifically, the so-called "trailing end smear", occurs. This image defect is attributable to a phenomenon that when a borderless print, or a bordered print, the trailing end of which is very small in border (margin), is printed, the trailing end portion of the transfer sheet P of the print is rubbed by the peripheral surface of the drum 205, whereby the portion of the toner image, which is on the trailing end portion of the transfer sheet P, is disturbed.

The mechanism of the occurrence of this phenomenon was elucidated by the inventors of the present invention who studied the photographs of the exit portion of the transfer nip T taken at 1,000 fps with the use of a high speed camera FASTCAM-1024PC (product of Photoron Co., Ltd.). FIGS. 17(A)-17(D) are schematic sectional views of the exit portion of the transfer nip T taken with preset intervals, and show the relationship between the trailing end portion of the transfer sheet P and the peripheral surface of the drum 206. A referential code P stands for the trailing edge of the transfer sheet P, and a referential code PC stands for the points of the peripheral surface of the photosensitive drum 205.

FIG. 17A shows the transfer nip T and its adjacencies at the moment when the trailing end of the transfer sheet P comes out of the transfer nip T. A referential code P4A stands for the position of the trailing edge of the transfer sheet P, and an IC4A stands for the position of the point of the peripheral surface of the drum 205, which corresponds in position to the trailing edge of the transfer sheet P. A dotted line in FIG. 17A indicates the path of the transfer sheet P when the transfer sheet P is in the state B, that is, when the transfer sheet P is remaining tightly stretched, being thereby perfectly flat, and referential code d4A stands for the amount of the downward bow (sagging) of the transfer sheet P.

FIG. 17B shows the state of the transfer nip T and its adjacencies P after the elapse of a preset length of time; it shows points P4B and IC4B, to which the points P4A and IC4A moved after the elapse of the preset length of time. A referential code d4B in FIG. 17B stands for the amount of the bow of the transfer sheet P after the elapse of the present length of time. As is evident from FIG. 17B, the amount d by which the transfer sheet P bows reduces with the elapse of time.

FIG. 17C shows the state of the transfer nip T and its adjacencies after the elapse of an additional (second) preset length of time; it shows points P4C and IC4C, to which the points P4B and IC4B moved with the elapse of the second preset length of time. A referential code d4C in FIG. 17C stands for the amount of the bow of the transfer sheet P after the elapse of the second present length of time. The trailing edge of the transfer sheet P has come out of the transfer nip T, but the trailing end portion of the transfer sheet P is still remaining in contact with the photosensitive drum 205 because of the presence of the electrostatic force attributable to the electrical charge given to the transfer sheet P during the image transfer onto the transfer sheet P.

FIG. 17D shows the state of the transfer nip T and its adjacencies P after the elapse of another (third) preset length of time; it shows points P4D and IC4D, to which the points P4C and IC4C moved after the elapse of the third preset length of time. A referential code d4D in FIG. 17D stands for the amount of the bow of the transfer sheet P after the elapse of the third present length of time. As is evident from FIG. 17D, the trailing end portion of the transfer sheet P has completely separated from the drum 205.

As is evident from FIG. 17, the amount of the distance which the trailing edge of the transfer sheet P moves during the period from the moment when the trailing edge of the transfer sheet P comes out of the transfer nip T (FIG. 17A) to the moment when the trailing edge of the transfer sheet P separates from the drum 205 (FIG. 17C), is smaller than the peripheral surface of the photosensitive drum 205 moves during the same period. Further, during the same period, the amount d by which the transfer sheet P bows simply reduces, because as the trailing edge of the transfer sheet P comes out of the transfer nip T, the transfer sheet P stops receiving the transfer sheet conveyance force from the transfer nip T, and therefore, reduces in speed, whereas the speed at which the transfer sheet P is conveyed through the fixation nip F does not change.

During the period from when the transfer sheet P is in the state shown in FIG. 17A to when the transfer sheet P is in the state shown in FIG. 17C, the trailing end portion of the transfer sheet P reduces in speed. Consequently, the trailing end portion of the transfer sheet P becomes different in speed from the peripheral surface of the photosensitive drum 205. Thus, the portion of the toner image, which is on the trailing end portion of the transfer sheet P is rubbed by the drum 205, being thereby smeared by the drum 205, because at this point during an image forming operation, the toner image on the recording sheet P is yet to be fixed. In other words, as the trailing end portion of the transfer sheet P becomes different in speed from the peripheral surface of the drum 205, the so-called "trailing end smear", that is, one of the serious image defects, occurs.

On the other hand, if the toner from the portion of a toner image extended for the formation a borderless print is on the peripheral surface of the drum 205, the trailing edge and/or back surface of the transfer sheet P is sometimes soiled.

Further, if the toner from the portion of a toner image extended for the formation of a borderless print is on the peripheral surface of the transfer roller 209, the trail end edge of the transfer sheet P and/or the back surface of the transfer sheet P is soiled while the trailing end portion of the transfer sheet P is rubbed by the transfer roller 209. This rubbing of the trailing end portion of the transfer sheet P by the photosensitive drum 205 and/or transfer roller 209 causes an image forming apparatus to output a print which suffers from "trailing end smearing", even if the print is a bordered print. For example, if a borderless print to be made is very narrow in margin. Therefore, the "trailing end rubbing" or the rubbing between the trailing end portion of the transfer sheet P and photosensitive drum 205, and/or the rubbing between the trailing end portion of the transfer sheet P and transfer roller 209, have to be prevented even when a bordered print is made.

SUMMARY OF THE INVENTION

Thus, the primary object of the present invention is to provide an image forming apparatus capable of outputting an excellent transferred image even if the trailing end portion of a sheet of recording medium reduces in speed in the transfer nip of the apparatus.

According to an aspect of the present invention, there is provided an image forming apparatus comprising a rotatable image carrying member for carrying a toner image; a rotatable transfer member cooperative with said image carrying member to form a transfer nip for nipping and feeding a recording material while transferring the toner image onto the recording material; a fixing unit having a fixing nip for nipping and feeding the recording material discharged from the transfer nip while fixing the toner image transferred onto the recording material; a bowing amount measuring unit for measuring a bowing amount of the recording material which is fed while being nipped by said transfer nip and fixing nip; and a speed controller for controlling a feeding speed of the recording material by said fixing nip, wherein said speed controller is capable of effecting a control of the feeding speed of said fixing nip on the basis of a result detection of the bowing amount measuring unit such that the bowing amount is substantially zero at the time when a trailing end of the recording material goes out of said transfer nip.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. However, the measurements, materials, and shapes of the structural components of the image forming apparatuses in the preferred embodiments of the present invention, and the positional relationship among the components, are to be altered as necessary according to the structure of an apparatus to which the present invention is applied, and various conditions under which the apparatus is operated. In other words, the following preferred embodiments of the present invention are not intended to limit the present invention in scope.

Embodiment 1

Figure 1:
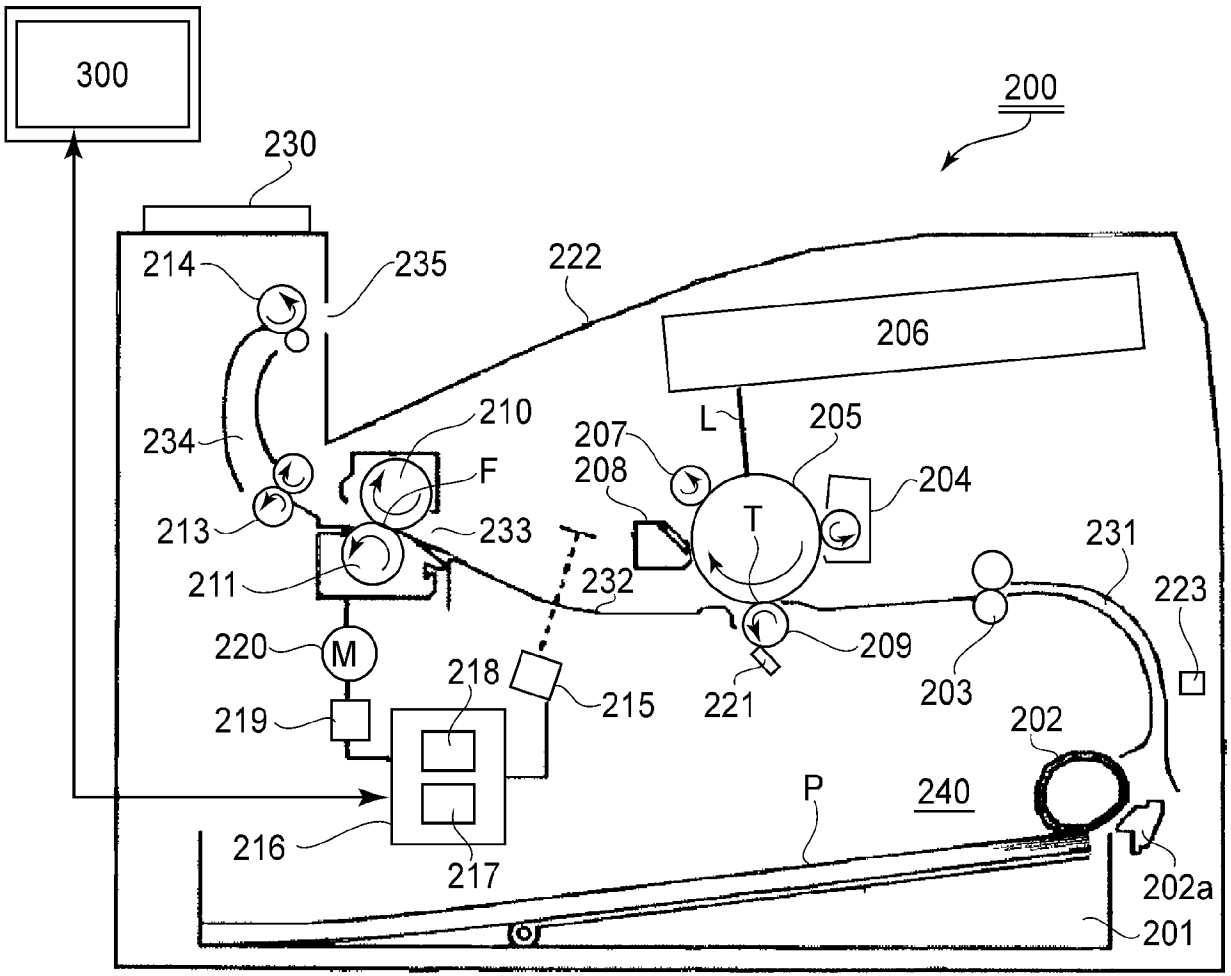
FIG. 1 is a schematic sectional view of the image forming apparatus in the first embodiment of the present invention, and shows the general structure of the apparatus.

FIG. 1 is a schematic sectional view of the image forming apparatus in the first embodiment of the present invention, and shows the general structure of the apparatus. This image forming apparatus 200 is an electrophotographic monochromatic laser printer of the so-called transfer type. It forms an image on a sheet P of recording medium (which hereafter may be referred to as transfer medium), based on the image information (electrical image formation signals) inputted into the print controller 216 (control section) of the apparatus 200 from a host apparatus 300, which is a personal computer, an image reader, a facsimile machine, and the like. A sheet P of transfer medium is a recording medium which is in the form of sheet, on which an image is formed by the apparatus 200. For example, it is a sheet of paper, labels, OHT film, or the like.

The controller 216 exchanges various electrical information with the host apparatus 300 and the control panel of the apparatus 200. It integrally controls the image forming operation of the apparatus 200 based on the one of the preset control programs and/or referential tables. That is, the image formation operation which will be described next is controlled by the controller 216. The control panel 230 is provided with various keys, displays, etc., which can be used by a user to set the image formation conditions, and the like, which the user wants, or input the image information into the controller 216.

The apparatus 200 has an electrophotographic photosensitive member 205 (rotatable photosensitive member, which hereafter will be referred to simply as drum) as an image bearing member, which is in the form of a drum. The drum 205 is rotated in the clockwise direction, indicated by an arrow mark, by a driving means (not shown), at a preset peripheral velocity (process speed).

The apparatus 200 has also electrophotographic processing devices for processing the drum 205, which are in the adjacencies of the peripheral surface of the drum 205. The electrophotographic processing devices in this embodiment are a charge roller 207 (charging means), an exposing device 206 (exposing means), a developing device 204 (developing means), a transfer roller 205 (transferring means), and a drum cleaner 208 (cleaning means), etc.

To the charge roller 207, a preset charge bias is applied from an electric power source (not shown). As the preset bias is applied to the charge roller 207, the charge roller 207 uniformly charges the peripheral surface of the drum 205 to a preset polarity and a potential level. The exposing device 206 in this embodiment is a laser scanner, which has a semiconductor laser, a rotational polygonal mirror, an f-θ lens, a deflection mirror, etc. As the drum 205 is rotated, the scanner 206 scans the uniformly charged portion of the peripheral surface of the drum 205, with the beam L of laser light it emits while modulating (turning on or off) the beam of laser light according to the image information (image formation signals) inputted from the controller 216, in the primary scanning direction which is parallel to the generatrix of the drum 205. As the uniformly charged portion of the drum 205 is exposed by the scanner 206, electric charge is removed from the exposed points of the uniformly charged portion of the peripheral surface of the drum 205. As a result, an electrostatic latent image (electrostatic image), which reflects the pattern of exposure of the peripheral surface of the drum 205, is effected on the uniformly charged portion of the peripheral surface of the drum 205.

The developing device 204 develops the electrostatic latent image on the peripheral surface of the drum 205, into a visible image, that is, an image (unfixed image) formed of toner (which hereafter may be referred to simply as a toner image), by supplying the drum 205 with toner. The transfer roller 209 is under the drum 205, and is in contact with the downwardly facing portion of the peripheral surface of the drum 205. It is rotated by the rotation of the drum 205. The area of contact between the peripheral surface of the drum 205 and the peripheral surface of the transfer roller 209 is a transfer nip T in which a toner image is transferred onto a sheet P of recording medium from the drum 206.

The sequence in which the transfer of a toner image from the drum 206 onto a sheet P of recording medium is carried out in the nip T as follows. That is, the sheet P is introduced into the nip T from a sheet feeding/conveying mechanism 240, and then, is conveyed through the nip T. While the sheet P is conveyed through the nip T, a preset transfer bias, which is opposite in polarity from the intrinsic toner polarity is applied to the roller 209 from an electric power section (not shown), whereby the toner image on the drum 206 is electrostatically transferred onto the sheet P.

The sheet feeder cassette 201 of the sheet feeding/conveying mechanism 240 stores multiple sheets P of recording medium in layers. Thus, as a pickup roller 202 is driven with a preset control timing (sheet feeding timing), the topmost sheet P of recording medium is pushed inward of the main assembly of the apparatus 200 by the pickup roller 20. Thus, it is moved into the main assembly while being separated from the rest of the sheets P in the cassette 201 by a separation pad 202*a*. Then, it is introduced into a sheet passage 231, which leads to the transfer nip T.

There is a pair of registration rollers 203 in the sheet passage 31. Except when a sheet P of recording medium needs to be conveyed beyond the registration rollers 203, the registration rollers 203 are kept stationary. Thus, as a sheet P of recording medium reaches the nip between the pair of registration rollers 203, it is caught by its leading edge, by the nip, while being pushed by the pickup roller 202. As a result, the entirety of the leading edge of the sheet P is placed in contact with the nip. Therefore, even if the sheet P happens to be conveyed askew, it is corrected in position.

Then, the pair of registration rollers 203 are driven with a preset control timing. As the registration rollers 203 begin to be driven, the sheet P of recording medium is conveyed through the nip, while remaining pinched by the pair of registration rollers 203, and is introduced into the transfer nip T. That is, not only do the pair of registration rollers 203 play a role of correcting a sheet P of recording medium in position, but also, a role of synchronizing the formation of a toner image on the drum 205, with the conveyance of the sheet P.

That is, as a sheet P of transfer medium is conveyed to the pair of registration rollers 203, the rollers 203 temporarily hold the sheet P in such a manner that the leading edge of the sheet P remains at a preset point in the sheet conveyance passage 31. Then, they start conveying the sheet P by releasing the sheet P with such a timing that the leading edge of a toner image on the photosensitive drum 205 reaches the transfer nip N at the same time as the printing (transfer) start line of the sheet P.

After being conveyed out of the nip T, the sheet P is separated from the drum 205, and is conveyed to a fixing device 233 (fixing device) while being guided by a sheet guiding members 232. The transfer residual toner, that is, the toner remaining on the peripheral surface of the photosensitive drum 205 after the separation of the sheet P from the photosensitive drum 205, is removed by the cleaner 208, so that the drum 205 can be repeatedly used for image formation.

The fixing device 233 in this embodiment is a thermal fixing device, which employs a heating film 210 and a pressure roller 211. The film 210 is an endless film, and is circularly moved. The pressure roller 211 is a pressure applying member, and is rotationally driven. The pressure roller 211 is kept pressed upon the fixation film 210, forming thereby a fixation nip F.

The pressure roller 211 is rotationally driven by a fixation motor 220 in the counterclockwise direction indicated by an arrow mark at a preset control speed. The fixation film 210 is circularly moved by the rotation of the pressure roller 211. The sheet P is introduced into the fixation nip F, and is conveyed through the fixation nip F while remaining pinched between the fixation film 210 and pressure roller 211. While the sheet P is conveyed through the fixation nip F, heat is applied to the sheet P and the unfixed toner image thereon from a heater (not shown) through the fixation film 210. Thus, the unfixed toner image is fixed to the sheet P by the heat and the nip pressure, becoming thereby a solid image.

A thermal fixing device, such as the above-described thermal fixing device 233, which employs a heating film and a pressure roller, has been well-known as a thermal fixing device of the on-demand type, and therefore, is not going to be described in detail here. After being conveyed out of the fixing device 233, the sheet P is conveyed further through a sheet passage 234, which includes a pair of sheet conveyance rollers 213 and 214. Then, it is discharged as a finished print, into a delivery tray 222, which makes up a part of the top wall of the main assembly of the apparatus 200.

The image forming apparatus 200 is enabled to operate in a borderless printing mode. The controller 216 is made up of a CPU 217, memories such as ROMs and RAMs, in which various data and control programs necessary for image forming operations in the borderless printing mode, bordered printing mode, etc., are stored. The instruction for selecting the borderless printing mode or bordered printing mode is inputted through the host apparatus 300 or the control panel 230 of the apparatus 200.

As the controller 216 receives borderless printing mode signals, it carries out the control sequence for yielding a borderless print. In the borderless printing mode, a mask, which is for defining the area of a sheet P of transfer medium, which is to be covered with a toner image, is made larger than the sheet P so that as a toner image is transferred onto the sheet P, it extends beyond the leading, trailing, left and right edges of the sheet P by a preset width (2 mm), to yield a borderless print. That is, a toner image, which is large enough to extend beyond the leading, trailing, left, and right edges of the sheet P, is formed on the peripheral surface of the drum 205, so that as the toner image is transferred onto the sheet P of transfer medium by transferring the toner image onto the sheet P by the transfer roller 209, a borderless print is made.

As described above, the borderless printing mode is such a printing mode that a toner image which is large enough to extend beyond the four edges of a sheet P of transfer medium (as recording medium) as it is transferred onto the sheet P, is formed on the photosensitive drum 205 (image bearing member), and then, is transferred onto the sheet P. Using this borderless printing mode method to yield a borderless print can ensure that a borderless print is always yielded as a toner image is transferred onto the sheet P of transfer medium, even if the transfer sheet P is conveyed askew through the transfer nip T because of a transfer medium conveyance error, and/or the transfer sheet P is inaccurately positioned relative to the roller 209 in terms of the lengthwise direction of the roller 209.

Also in the borderless printing mode, the toner transferred onto the peripheral surface of the roller 209 from the portions of the toner image on the drum 205, which are to extend beyond the leading, trailing, left, and right edges of a sheet of recording medium, is removed from the peripheral surface of the roller 209 by a cleaning means 221, which is a urethane rubber blade.

In this embodiment, the image forming apparatus 200 is provided with a distance measuring means 215 of the non-contact type (which is not placed in contact with transfer sheet P), which is a means for measuring the amount by which the transfer sheet P bows. The distance measuring means 215 in this embodiment is an optical distance measuring sensor. In terms of the recording medium conveyance direction, it is between the transfer nip T, and the fixation nip F which is on the downstream side of the transfer nip T. In terms of the vertical direction, it is below the transfer sheet guiding members 232. This sensor 215 is such a sensor that can measure the distance between itself and the transfer sheet P (which is to be measured in the amount of downward bow (sagging)), without being placed in contact with the transfer sheet P.

Figure 2:
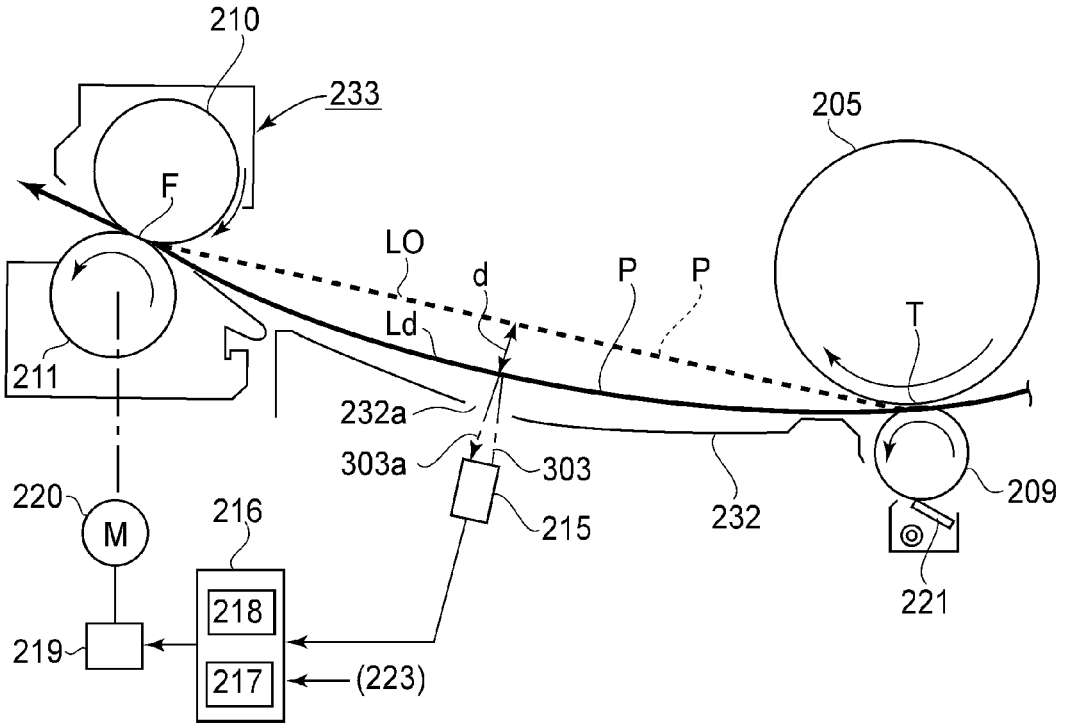
FIG. 2 is an enlarged schematic sectional view of a part of FIG. 1.

FIG. 2 is an enlarged schematic sectional view of a part of FIG. 1, which is between the transfer nip T and fixation nip F. The sensor 215 is on the bottom side of the guiding members 232, and is at roughly the center between the transfer nip T and fixation nip F. That is, the sensor 215 is positioned roughly the same distance from the transfer nip T and fixation nip F, and therefore, it can measure the amount d by which the transfer sheet P bows, at the point at which the amount d is largest.

The guiding member 232 is provided with a hole (window) 232*a*, which allows a beam 303 for detecting the distance from the sensor 215 to the transfer sheet P to be projected to the transfer sheet P, and a beam 303*a*, that is, the beam 303 reflected by the transfer sheet P to return to the sensor 215. The hole 232*a* is positioned so that it aligns with the sensor 215.

Figure 3:
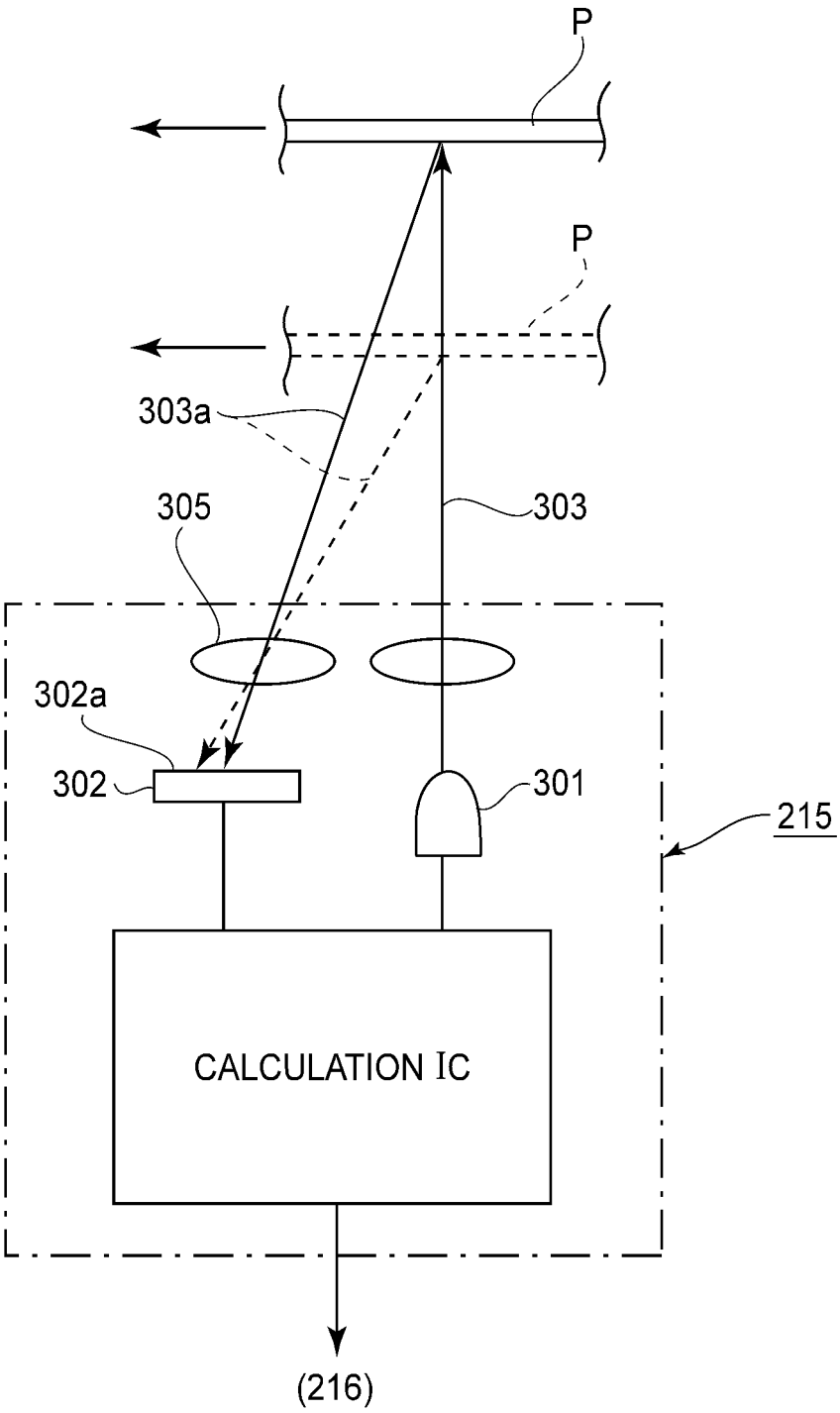
FIG. 3 is a drawing for describing a noncontact distance measuring means (optical distance measuring means) and how the means works.

Referring to FIG. 3, the sensor 215 is made up of a light emitting section 301 (LED) and a PSD 302 (Positive Sensitive Device: position detection element). More specifically, the beam 303 of laser light is emitted from the light emitting section 301 toward the transfer sheet P, which is the distance detection target. The beam 303 hits the transfer sheet P, and is diffusively reflected toward a light focusing means 305 positioned in front of the light sensing surface 302*a* of the PSD 302, being thereby guided to the light sensing surface 302*a*. Thus, the sensor 215 measures the distance from itself to the transfer sheet P by triangulation, based on the position of the center of the distribution of the beam 303*a* of infrared light having reached to the light sensing surface 302*a*.

Figure 4:
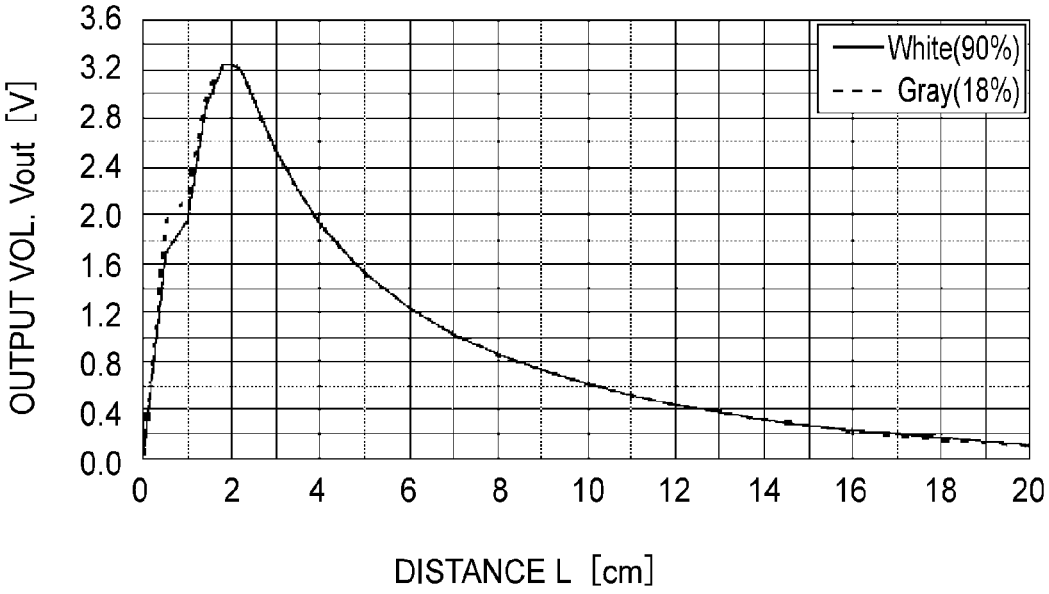
FIG. 4 is a graph which shows the relationship between the amount of distance detected by the noncontact distance measuring means (optical distance sensor), shown in FIG. 3, and the output voltage of the sensor.

That is, the distance from the sensor 215 to the transfer sheet P is obtained by detecting the position of the center of the distribution of the part of the beam 303*a* of infrared light which reaches the light sensing surface 302*a*, and converting the position of the center into the distance. Therefore, the changes in the reflectivity of the transfer sheet P attributable to the superficial condition of the transfer sheet P do not affect the distance data. The position detected by the light sensing section 302 is converted into the distance between the sensor 215 and the transfer sheet P by an arithmetic IC, and is outputted in the form of electrical voltage. The relationship between the distance detected by the sensor 215 and the output voltage of the sensor 215 is shown by FIG. 4. In this embodiment, the sensor 215 is positioned so that the distance from the sensor 215 to the transfer sheet P (distance measurement target) will fall within a range of 3-6 cm. Referring to FIG. 4, a line "White (90%)" stands for the relationship between the output voltage of the sensor 215 and the distance from the sensor 215 to a sheet P of white transfer medium, which is 90% in reflectivity, and a line "Gray (18%)" stands for the relationship between the output voltage of the sensor 215 and the distance from the sensor 215 to a sheet P of gray transfer medium, which is 18% in reflectivity.

As a sheet P of transfer medium is introduced into the transfer nip T, it is conveyed through the transfer nip T while remaining pinched by the drum 205 and transfer roller 209. While the transfer sheet P is conveyed through the transfer nip T, the toner image on the drum 205 is transferred onto the transfer sheet P. Then, the transfer sheet P is conveyed out of the transfer nip T. As the transfer sheet P is conveyed out of the transfer nip T, it is separated from the peripheral surface of the drum 205, and is conveyed further to the fixation nip F, with its leading edge portion being guided by the surface of the guiding member 232. As it is conveyed to the fixation nip F, it is conveyed through the fixing nip N while remaining pinched by the fixation film 210 and pressure roller 211. The length of the transfer sheet conveyance passage between the transfer nip T and fixation nip F is less than the dimension of the transfer sheet P in terms of the transfer medium conveyance direction. Therefore, the moment when the leading edge of the transfer sheet P reaches the fixation nip F, the trailing edge portion of the transfer sheet P is still in the transfer nip T. That is, there is a period in which the transfer sheet P remains pinched by both the transfer nip T and fixation nip F.

As the transfer sheet P is conveyed further, the trailing edge portion of the transfer sheet P comes out of the transfer nip T, and eventually, comes out of the fixation nip F. As the transfer sheet P is conveyed between the transfer nip T and fixation nip F, the sensor 215 continuously measures the distance between itself and the bottom surface of the transfer sheet P, and inputs the measured distance into the controller 216, which controls the amount d of the bow of the transfer sheet P, based on the information inputted into the controller 216 by the sensor 215, while the transfer sheet P remains pinched by both the transfer nip T and fixation nip F.

That is, the position of the center of distribution of the beam 303*a* of infrared light diffusively reflected by the transfer sheet P is detected by the light sensing surface 302*a* of the sensor 215, and is converted by the arithmetic IC into the distance from the sensor 215 to the transfer sheet P, as described above. Then, the distance is outputted in the form of electric voltage by the sensor 215, and inputted into the controller 216. Then, the electrical voltage is converted (A/D conversion) by a CPU 217 with which the controller 216 is provided; the distance is digitized. The memory 218 of the controller 216 stores a digital value proportional to the distance from the sensor 215 to the transfer sheet P when the transfer sheet P is in the state B defined by FIG. 6, that is, the state in which the portion of the transfer sheet P, which is between the transfer nip T and fixation nip F, is kept flat, and digital values proportional to the distances from the sensor 215 to the transfer sheet P when the portion of the transfer sheet P, which is between the transfer nip T and fixation nip F, is bowing downward (sagging). Thus, the amount d of the bow of the transfer sheet P can be obtained through the computation by the CPU 217 of the controller 216, based on the digital value of the distance between the sensor 215 to the transfer sheet P when the transfer sheet P is in the aforementioned state B, and that when the aforementioned portion of the transfer sheet P is bowing downward (sagging).

Then, the controller 216 controls the speed at which the pressure roller 211 is rotated by the fixation motor 220, so that the amount d by which the transfer sheet P is bowing between the transfer nip T and fixation nip F remains at a preset value to prevent the transfer sheet P from being excessively tensioned, or excessively bowing, between the transfer nip T and fixation nip F.

The pressure roller 211 is driven by the fixation motor 220 which is controlled by the controller 216, being therefore changeable in rotational speed. That is, the rotational speed of the pressure roller 211 is switchable between a speed lower than the transfer sheet conveyance speed in the transfer nip T and a speed higher than the transfer sheet conveyance speed in the transfer nip T. More concretely, the controller 216 receives, through it's A/D port, the voltage which is outputted from the sensor 215 as shown in FIG. 4, and outputs to a motor driver 219, clock signals in order to vary in speed the fixation motor 220 in proportion to the current amount d of bowing of the transfer sheet P between the transfer nip T and fixation nip F so that the amount d is kept at the preset value. This is how the controller 216 controls the roller 211 in rotational speed.

To describe in more detail, the memory 218 of the controller 216 stores target values (dtgt) for the amount of bowing of the transfer sheet P, which correspond to recording medium types and sheet conveyance modes. Thus, the target value dtgt for the amount of bowing of the transfer sheet P can be varied based on the instruction from a customer (user), or the outputs of the sensor 223 (FIG. 1) positioned in the adjacencies of the transfer sheet passage 231 to identify the type of the transfer sheet P. The speed of the fixation motor 220 is controlled by outputting control signals from the CPU 217 to the motor driver 219 so that the actual amount d of bowing of the transfer sheet P converges to the target value dtgt.

It is the sensor 215 described above that is the means for measuring the amount d by which the transfer sheet P bows while the leading and trailing edge portions of the transfer sheet P remain pinched by the fixation nip F and transfer nip T, respectively. Further, the controller 216 is the speed controlling portion which controls the speed, at which the transfer sheet P is conveyed by the fixation nip F, based on the output of the sensor 215 which is the means for measuring the amount of bowing of the transfer sheet P.

The controller 216 controls the fixation nip F in recording medium conveyance speed so that the amount d of bowing of the transfer sheet P will become roughly zero by the time when the trailing edge of the transfer sheet P comes out of the transfer nip T. Next, this control is described in more detail.

First, the method for controlling the speed of the fixation motor 220 in the borderless printing mode, starting from the moment when the leading edge of the transfer sheet P enters the fixation nip F, will be described. This speed control is for making the amount e of deviation of the actual amount d of bowing of the transfer sheet P from the target value dtgt converge to "zero". The principle of this control can be expressed in the form of the following equation (Equation (1)). This control is a PI control. That is, the rotational speed of the fixation motor 220 is controlled based on two parameters (coefficients), that is, the amount e (=d−dtgt) of deviation of the amount d of bowing of the transfer sheet P from the target value dtgt, and the value obtained by integrating the amount e:

$$MV=Kp\cdot c+Ki\cdot\int edt+Ms \quad (1)$$

MV: actual speed of motor (motor frequency)

e: amount of deviation of actual amount of bowing from target value (e=d−dtgt)

Kp: constant of proportionality for proportional control (coefficient of proportionality for changing amount of operation in response to e)

Ki: constant of proportionality for integral control (coefficient of proportionality for changing amount of operation in response to ∫c)

Ms: amount of operation under normal condition (motor frequency when e=0: fundamental frequency).

The values for the control parameters listed above were determined in consideration of the changes in the external diameter of the pressure roller 211 attributable to thermal expansion. The value for Parameter Kp (proportional gain) for proportional control was determined within a range in which the amount d of bowing does not overshoot the target value dtgt, or bowing does not occur, for the following reason. That is, if overshooting or bowing occurs, the transfer sheet P is excessively pulled by the fixation nip F. Therefore, such problems as the misalignment of the toner image on the photosensitive drum 205 with the transfer sheet P sometimes occur in the transfer nip T.

Further, if the amount of difference between the actual amount d of bowing of the transfer sheet P and the target value dtgt cannot be eliminated by the proportional control alone, the value for Parameter Ki was set to eliminate the difference by the integral control. The addition of the integral control repeatedly causes changes in output as long as the difference is present. Thus, eventually, it can eliminate the difference (offset): it can make the amount d of bowing of the transfer sheet P converge to one of the target values. The value for Parameter Ki also was set within a range in which the amount d does not overshoot the target value dtgt, and bowing does not occur.

Therefore, while the transfer sheet P is conveyed between the transfer nip T and fixation nip F, with the leading and trailing end portions of the sheet P remaining pinched by the fixation nip F and transfer nip T, respectively, the amount d of bowing of the transfer sheet P simply reduces, and converges to one of the target values, before the trailing edge of the transfer sheet P comes out of the transfer nip T.

Figure 5:
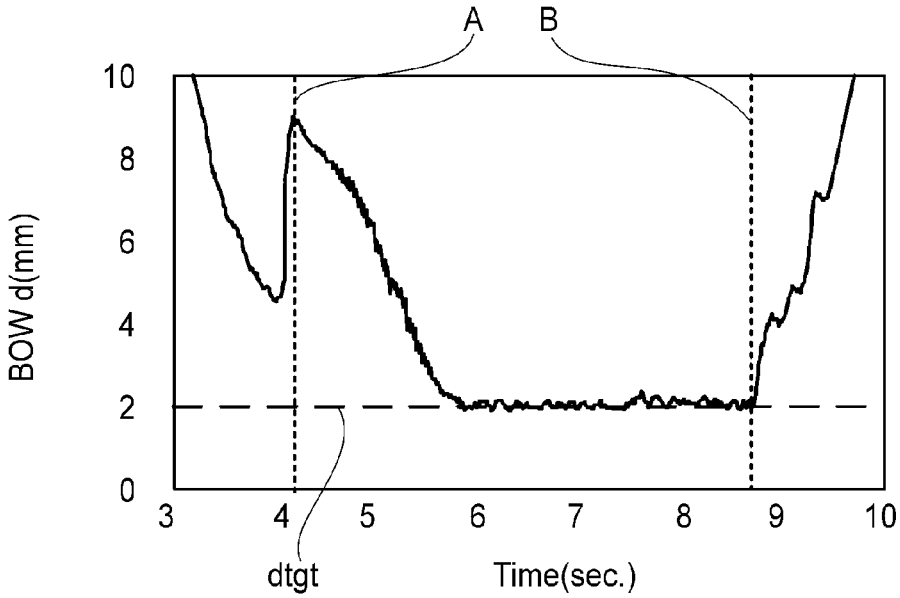
FIG. 5 is a graph which shows the relationship between the amount of the bow of a sheet of recording medium and the elapsed length of time.

Shown in FIG. 5 is an example of the changes which occurred to the amount d of bowing of the transfer sheet P with the elapse of time, when this control was carried out under the condition that the process speed was 40 mm/sec, and the target value dtgt for the amount of bowing was 2.0 mm. A referential code A in FIG. 5 stands for the timing with which the leading edge of the transfer sheet P entered the fixation nip F, that is, the timing with which the control was started. A referential code B stands for the timing with which the trailing edge of the transfer sheet P came out of the transfer nip T, that is, the timing with which the control ended. As will be evident from FIG. 5, the control described above makes the amount d of bowing of the transfer sheet P to converge to the target value dtgt. That is, the trailing edge of the transfer sheet P comes out of the transfer nip T, with the amount d of the transfer sheet bowing remaining at the target value dtgt.

Figure 6:
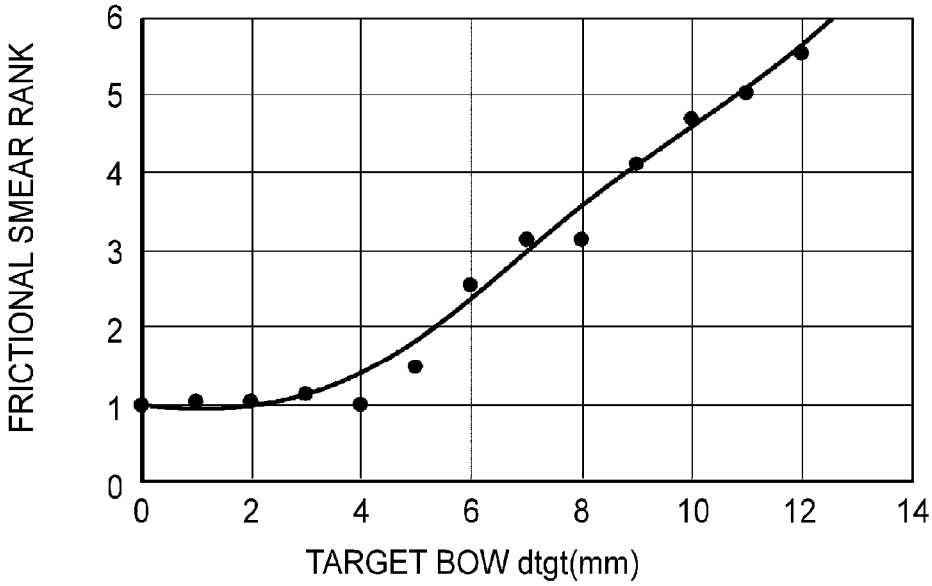
FIG. 6 is a graph which shows the ranking of the frictional smear across the trailing edge portion of a sheet of recording medium, and the target value for the downward bow of the recording medium.

FIG. 6 shows the results of the experiment carried out to find out the relationship between the target value dtgt for the transfer sheet bow and the amount (evaluation) of rubbing between the trailing end portion of the transfer sheet P and the peripheral surface of the drum 205 when this control was carried out. The horizontal axis in FIG. 6 stands for the amount d of bowing of the transfer sheet P (target value dtgt) at the moment when the trailing edge of the transfer sheet P came out of the transfer nip T, and the vertical axis stands for the numerical ranking (evaluation) of images in terms of the rubbing (smear) of the trailing end portion of the transfer sheet P.

The transfer medium used for the experiment was gloss paper (Color Laser Photo Paper, Glossy: product of Hewlett Packard Co., Ltd.), and two different images A and B different in pattern were used.

The image A was a halftone image made up of horizontal lines, which were two-dot wide (equivalent to resolution of 600 dpi), and the intervals of which were equivalent to three dots. The image B was made up of English alphabets which were Times New Roman in type face and 10 point in size. The dots of the image A were aligned in the direction perpendicular to the direction in which the trailing end portion of the transfer sheet P was rubbed. In other words, the image A was excellent for detecting the "image smear" attributable to "trailing end rubbing".

The definition of image ranking is as follows: 10 prints were continuously made, and the average ranking of 10 prints was used as the "image ranking".

0: zero smearing

1: microscopic amount of smearing (detectable only with microscope)

2: slight amount of smearing (detectable with naked eyes only on image A: near limit of detection by naked eyes 3: slight amount of smearing (detectable with naked eyes only on image A)

4: slight amount of smearing detectable on ordinary print (slight smearing detectable on image B 5: smearing detectable on practical pattern of ordinary print (smearing easily detectable on image B with naked eyes)

6: conspicuous smearing (clearly problematic to customer (user)).

As is evident from the results of the experiment given in FIG. 6, the smaller the amount d of bowing, the smaller the amount of rubbing of the trailing end portion of the transfer sheet P. However, when the amount d of bowing was zero, the transfer sheet P was excessively pulled by the fixation nip F while the trailing end portion of the transfer sheet P was remaining pinched by the transfer nip T. Thus, such a problem that the transfer sheet becomes misaligned with the toner image on the drum 205 and/or the misalignment offset in the transfer medium conveyance direction sometimes occurred. Thus, in a case where the amount d of bowing is wanted to be zero, the speed of the fixation motor 220 has to be set to be within a range in which "image misalignment" and/or "magnification offset" does not occur.

Figure 7:
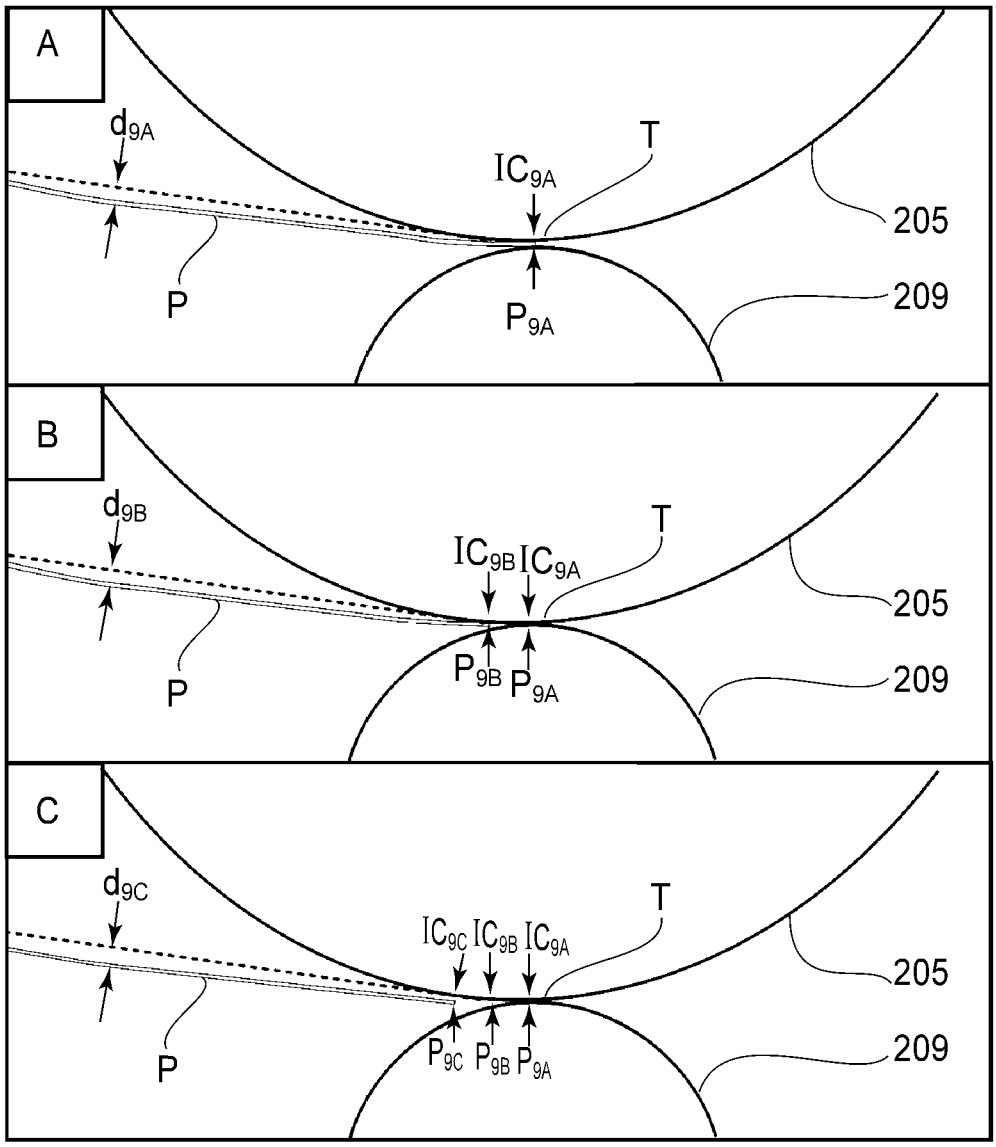
FIG. 7 is a schematic sectional view of the transfer nip and its adjacencies, and shows the behavior of the trailing edge portion of a sheet of recording medium in the adjacencies of the downstream end of the transfer nip.
Figure 17:
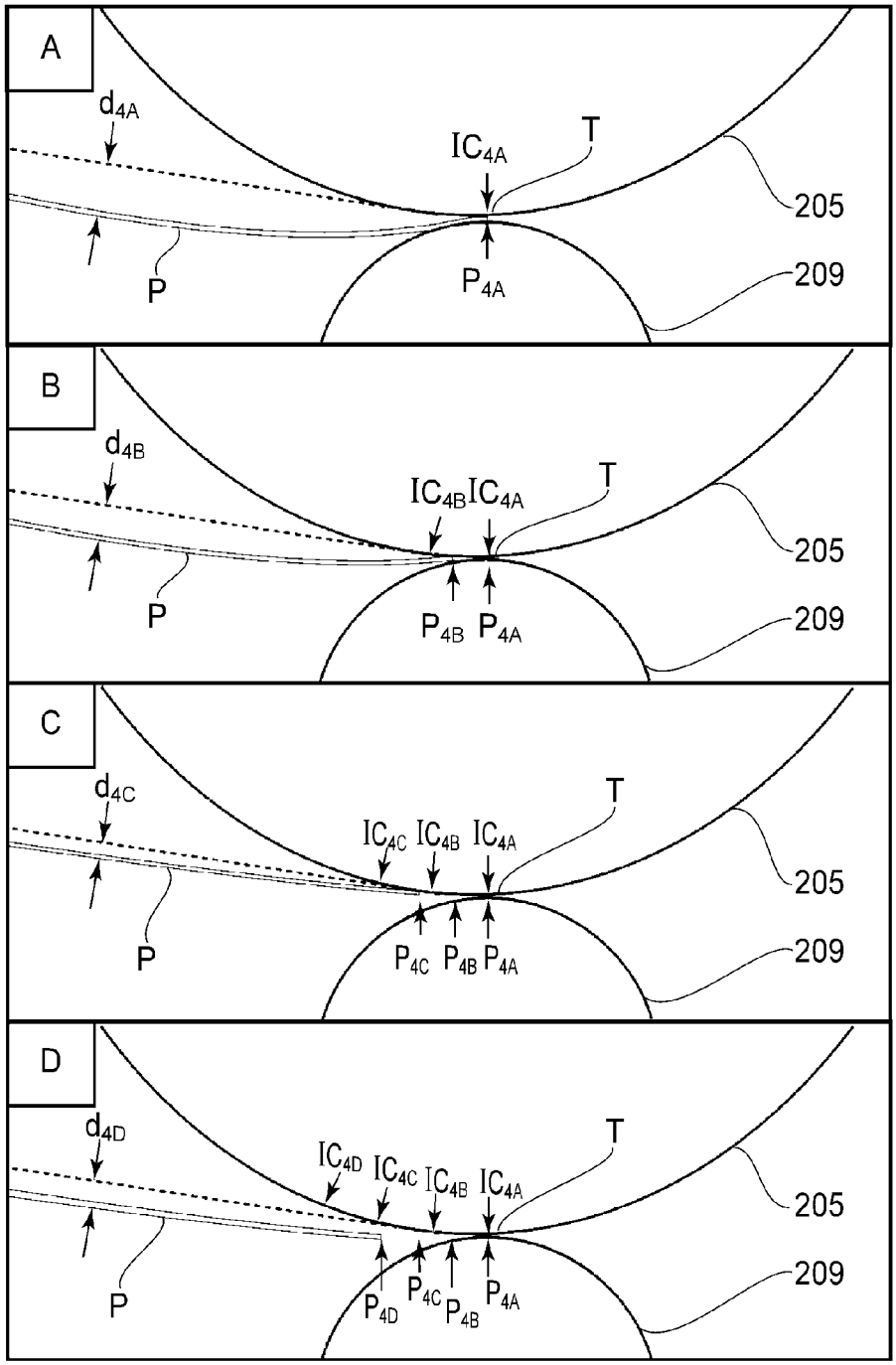
FIG. 17 is a schematic sectional view of the transfer nip and its adjacencies, and shows the behavior of the trailing edge portion of a sheet of recording medium, in the adjacencies of the downstream end of the transfer nip in terms of the recording medium conveyance direction.

The exit portion of the transfer nip T was photographed with a high speed camera FASTCAM-1024PC (product of Photoron Co., Ltd.) at 1,000 fps. Then, the photographs were compared with the high speed photographs (FIG. 17) of the exit portion of the transfer nip T of a conventional image forming apparatus to study the mechanism of how the trailing end portion of a sheet P of recording medium is rubbed by the peripheral surface of the drum 205. FIG. 7 is a schematic drawing of the transfer nip T and its adjacencies when the target value dtgt for the transfer sheet sag was 1.0 mm, and virtually no part of the trailing end portion of a sheet P of transfer medium was rubbed.

The comparison of the results (FIG. 17) of the observation of the conventional image forming apparatus with those of the image forming apparatus in this embodiment, which was controlled so that the amount d of bowing became roughly zero at the moment when the trailing end portion of the transfer sheet P came out of the transfer nip T, proved that the transfer sheet P was prevented from reducing in speed right after coming out of the transfer nip T, by controlling the image forming apparatus so that the amount d of bowing of the transfer sheet P becomes virtually zero the moment when the trailing edge of the transfer sheet P comes out of the transfer nip T, as in this embodiment. That is, the amount of distance the trailing edge of the transfer sheet P moves between when it comes out of the transfer nip T at Point 9A and when it separates from the drum 205 at Point P9B is practically the same as the amount of distance the peripheral surface of the drum 205 moves (distance from IC9A to ICB).

That is, the speed at which the trailing end portion of the transfer sheet P moves immediately after it comes out of the transfer nip T is roughly the same as the peripheral velocity of the photosensitive drum 205. Therefore, the trailing end portion of the transfer sheet P is not rubbed by the photosensitive drum 205. Thus, the image forming apparatus in this embodiment can yield excellent prints.

Further, the sensor employed in this embodiment to measure the amount d of bowing of the transfer sheet P is the optical distance sensor 215, that is, a sensor of noncontact type. If a distance sensor of the contact type is employed to measure the distance from the sensor to the back surface of the transfer sheet P, the distance sensor presses the transfer sheet P upon the photosensitive drum 205 as an image bearing member, exacerbating the trailing end rubbing. Thus, a distance sensor of the noncontact type, such as the optical distance sensor 251 in this embodiment, is advantageous over a distance sensor of the contact type, from the standpoint of the prevention of the rubbing of the trailing end portion of the transfer sheet P.

In this embodiment, the image forming apparatus, which is enabled to operate in the borderless printing mode, is provided with the distance sensor 215 of the noncontact type, and the amount d by which the transfer sheet P bows between the transfer nip T and fixation nip F is controlled based on the output of the sensor 25 so that the amount d becomes practically zero the moment when the trailing edge of the transfer sheet P comes out of the transfer nip T. Therefore, it does not occur that the trailing end portion of the transfer sheet P and the peripheral surface of the photosensitive drum 205 rub against each other. Thus, the image forming apparatus in this embodiment can output excellent images.

Next, the concrete structural requirements for enabling the image forming apparatus in this embodiment to prevent the trailing end portion of the transfer sheet P and the peripheral surface of the photosensitive drum 205 from rubbing each other are described. Referring to FIG. 2, a referential code Ld stands for the length of the path of the transfer sheet P when the transfer sheet P is conveyed between the transfer nip T and fixation nip F and the amount d of bowing of the transfer sheet P is not zero. A referential code L0 stands for the length of the path of the transfer sheet P when the transfer sheet P is conveyed between the transfer nip T and fixation nip F and the amount d of bowing of the transfer sheet P is zero, that is, when the transfer sheet P is conveyed while being perfectly stretched. Further, a referential code AL stands for the amount of difference between Ld and L0. Assuming that the cross-section of the bowing transfer sheet P at a plane parallel to the transfer sheet conveyance direction is in the form of an arc, AL can be approximated with the use of the following mathematical formulas (2) and (3), which are functions of the amount d of bowing of the transfer sheet P and L0:

$$\Delta L = 2 \cdot L0 \cdot ASIN(L0/2 \cdot R) - L) \quad (2)$$

$$R = (d/2) + (L0^2/8 \cdot d) \quad (3)$$

Figure 8:
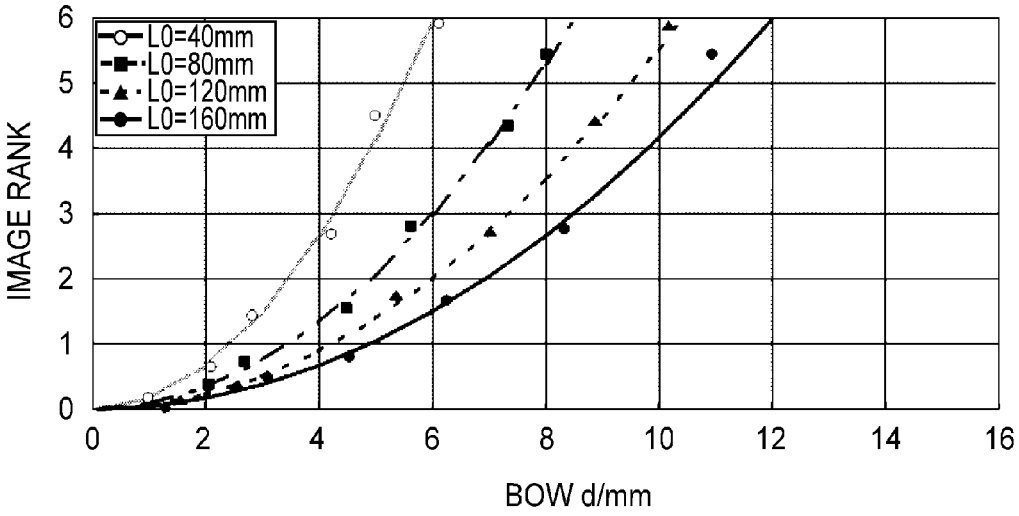
FIG. 8 is a graph which shows the relationship between the image ranking and the amount of the bow of a sheet of recording medium.

Shown in FIG. 8 are the results of the ranking of the images outputted in an experiment in which L0 (distance from transfer nip T to fixation nip F) and target value dtgt were varied. L0 was set to 40 mm, 80 mm, 120 mm and 160 mm by changing the fixing device 233 in position. The method used for ranking the images was the same as the one described above. The horizontal axis stands for the amount d of bowing of the transfer sheet P (target value dtgt), and the vertical axis stands for the image ranking. The results of the experiment were plotted for each value of L0, along with the approximate relationship (curved lines) between the image ranking and target values for the bowing.

Figure 9:
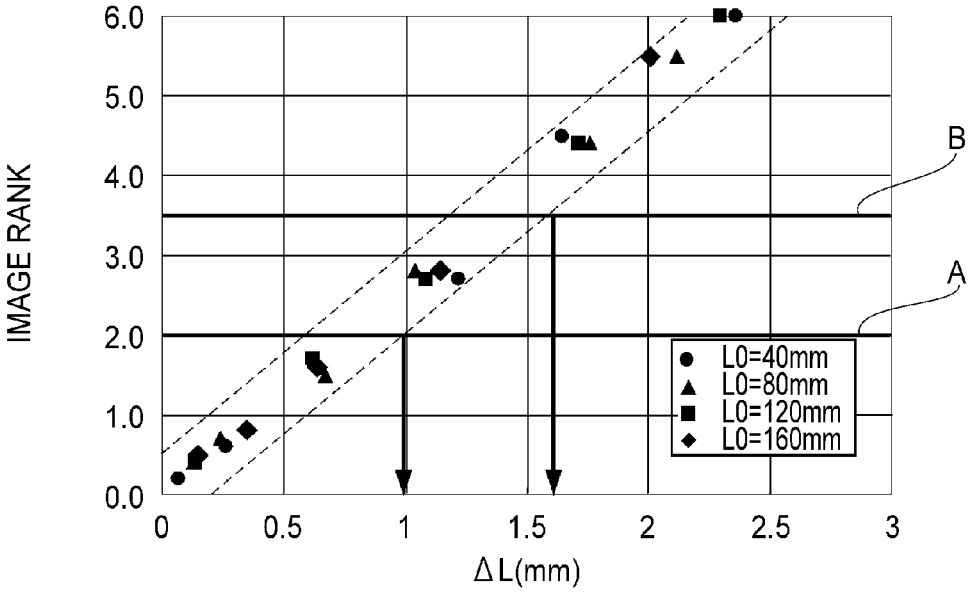
FIG. 9 is a graph which shows the relationship between the image ranking (in terms of tail end smear) and ΔL.

Further, the value of ΔL was calculated for each plot, from the value of L0 and the amount d of bowing, using the equations (2) and (3) given above. The results are shown in FIG. 9, in which the horizontal axis stands for ΔL, and the vertical axis stands for the image ranking. It is evident from FIG. 9 that there is a strong relationship between the image ranking (in terms of trailing end smearing attributable to rubbing) and ΔL (amount of difference between length of path of bowing transfer sheet P and that of perfectly stretched transfer sheet P). This occurred because the bowing of the transfer sheet P delayed the transmission of the force applied to the transfer sheet P by the fixing means, to the trailing end portion of the transfer sheet P, and therefore, the trailing end portion of the transfer sheet P remained at the exit portion of the transfer nip T for a length of time equal to the amount of the delay (distance).

The following are evident from the results of the examination of the images. In order for an image to be satisfactory in terms of the smearing of the trailing end portion of the transfer sheet P attributable to the rubbing between the trailing end portion of the transfer sheet P and the peripheral surface of the photosensitive drum 205, an image has to be no more than 3.5 (below line B in FIG. 9), preferably, 2.0 (below line B in FIG. 9), in image ranking. It is evident from FIG. 9, which shows the results of the experiment, that in order for the image forming apparatus 200 in this embodiment to be no higher than 3.5 in image ranking, AL has to be no more than 1.6 mm, and in order for the apparatus 200 to be no higher than 2.0 in image ranking, ΔL has to be no more than 1.0 mm.

Figure 10:
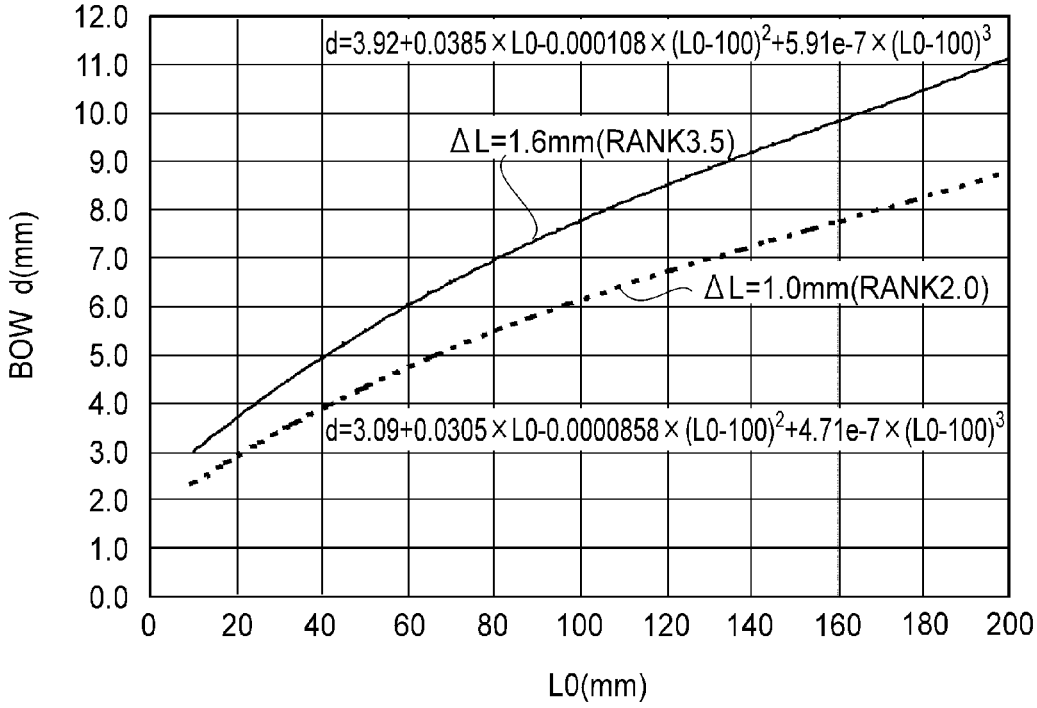
FIG. 10 is a graph which shows the relationship between the image ranking (in terms of tail end smear) and L0.

As is evident from the mathematical equations (2) and (3) given above, ΔL can be obtained as the function of L0 and d. Therefore, the amount d of bowing of the transfer sheet P when ΔL is 1.0 mm or 1.6 mm can be expressed as the function of L0. FIG. 10 shows the relationship between the amount d and L0 when the ΔL is 1.0 mm and 1.6 mm, and the equations for approximating the value of the amount d.

Thus, the desirability for making the image forming apparatus 200 no higher than 3.5 (smaller numerical value) in the image ranking in terms of the smearing of the trailing end portion of the transfer sheet P attributable to the rubbing between the trailing end portion of the transfer sheet P and photosensitive drum 205 can be expressed by the following mathematical formula:

$$0 \le d \le 3.92 + 0.0385 \times L0 - 0.000108 \times (L0-100)^2 + 5.91e^{-2} \times (L0-100)^3 \quad (4)$$

where e is the base of natural logarithms.

L0 (distance from transfer nip T to fixation nip F) is a parameter in the design of the image forming apparatus 200. Thus, with the use of the formula given above, the value of the amount d for making the image forming apparatus 200 satisfactory in terms of the smearing of the trailing end portion of the transfer sheet P can be obtained for any value for the parameter.

Further preferably, setting a value for the amount d of bowing of the transfer sheet P so that the amount d satisfies the following mathematical formula (5) can make the image forming apparatus 200 no higher than 2.0 (smaller numerical value) in image ranking in terms of the smearing of the trailing end portion of the transfer sheet P attributable to the rubbing between the trailing end portion of the transfer sheet P and photosensitive drum 205:

$$0 \le d \le 3.09 + 0.0305 \times L0 - 0.0000858 \times (L0-100)^2 + 4.71e^{-7} \times (L0-100)^3 \quad (5)$$

The extent to which the trailing end portion of the transfer sheet P is smeared by the rubbing between the trailing end portion of the transfer sheet P and photosensitive drum 205 is more or less affected by the type of the transfer sheet P used for image formation. In this embodiment, therefore, the target value dtgt for the amount d of the transfer sheet bowing can be adjusted based on the output of the sensor 223 capable of identifying the type of the transfer sheet P and/or by the instruction from a user.

As described above, the image forming apparatus in this embodiment, which is capable of operating in the borderless printing mode, controls the amount d of bowing of the transfer sheet P with the use of the distance sensor 215 of the noncontact type so that the amount d will become roughly zero the moment when the trailing edge of the transfer sheet P comes out of the transfer nip T, while it is forming an image. Therefore, the image forming apparatus 200 in this embodiment can prevent the rubbing between the trailing end portion of the transfer sheet P and photosensitive drum 205, and therefore, can output excellent images.

More concretely, it is desirable that the relationship between the amount d of bowing of the transfer sheet P measured at roughly the center between the transfer nip T and fixation nip F where the amount d becomes largest, and distance L0 between transfer nip T and fixation nip F, satisfies the following requirement:

$$0 \le d \le 3.92 + 0.0385 \times L0 - 0.000108 \times (L0-100)^2 + 5.91e^{-7} \times (L0-100)^3$$

preferably, $0 \le d \le 3.09 + 0.0305 \times L0 - 0.0000858 \times (L0-100)^2 + 4.71e^{-7} \times (L0-100)^3$.

With one of these mathematical formulas satisfied, it is possible to obtain excellent images in terms of the smearing of the trailing end portion of the transfer sheet P attributable to the rubbing between the trailing end portion of the transfer sheet P and photosensitive drum 205.

Further, in a case where the type of the transfer sheet P affects the extent of the smearing, the target value dtgt can be adjusted based on the output of the sensor 223 capable of identifying the type of the transfer sheet P, or by an instruction from a user. Such an instruction is to be inputted through the control panel 230 or host apparatus 300.

Further, even in a case where the image forming apparatus 200 is operated in the bordered printing mode, that is, a printing mode in which a print is created with the presence of borders (margins), the apparatus 200 has to be prevented from allowing the trailing end portion of the transfer sheet P from rubbing against the peripheral surface of the photosensitive drum 205, for the following reason. That is, even in a case where the apparatus 200 is operated in the bordered printing mode, the apparatus 200 sometimes yields unsatisfactory prints, because if the trailing end portion of the transfer sheet P rubs against the photosensitive drum 205 when a print being made is very small in margin. In this embodiment, the image forming apparatus 200 is controlled so that the trailing end portion of a transfer sheet P is prevented from rubbing against the photosensitive drum 205 even the apparatus 200 is operated in the bordered printing mode. Therefore, it can yield excellent prints.

Embodiment 2

The structure of the image forming apparatus in this embodiment is roughly the same as that in the first embodiment. That is, the only difference between the two apparatuses is the positioning of the optical distance sensor 215.

Here, therefore, only the positioning of the sensor 215 in this embodiment is described. In the first embodiment, the sensor 215 was positioned at roughly the middle between the transfer nip T and fixation nip F. Some image forming apparatuses, however, are restricted in terms of the space in their main assembly, making it impossible to place the sensor 215 at the middle between their two nips T and F. This embodiment is related to the target value dtgt for the amount d by which a transfer sheet P is allowed to bow downward. Thus, it clearly shows the requirements for allowing the sensor 215 to be optionally positioned.

Figure 11:
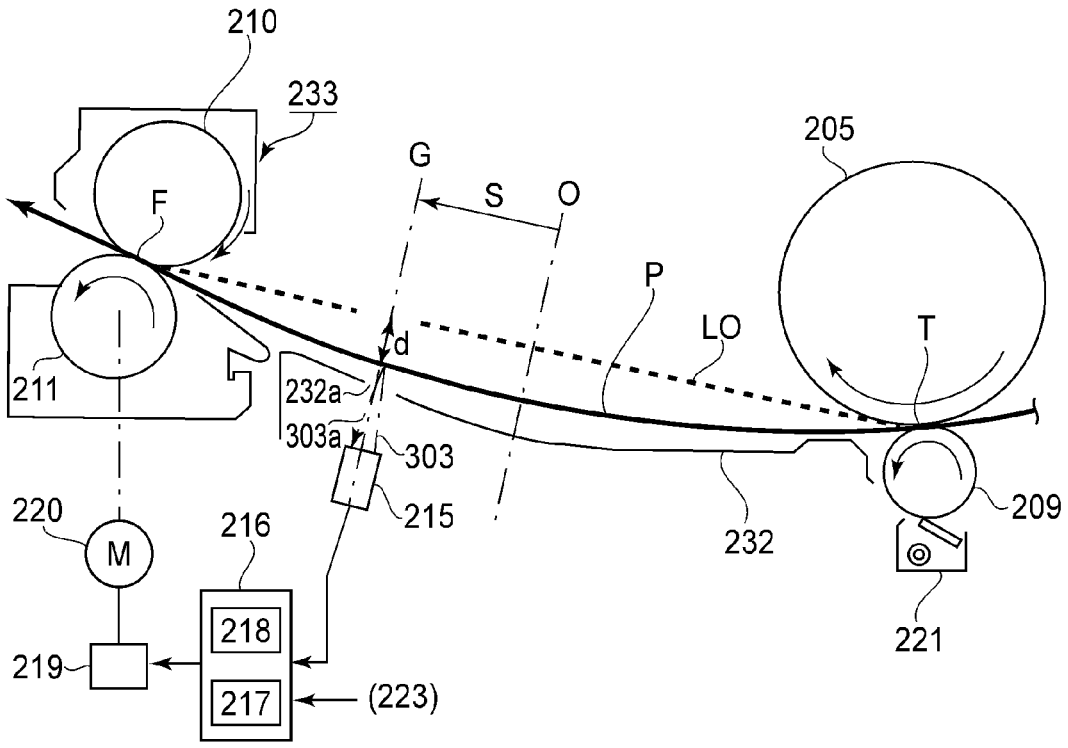
FIG. 11 is a schematic sectional view of the portion of the image forming apparatus in the second embodiment of the present invention, with which the present invention is directly related.

Referring to FIG. 11, in this embodiment, the sensor 215 is positioned at a position G, which is S mm toward the fixation nip F from the center O between the transfer sheet T and fixation nip F. Since the sensor 215 in this embodiment is offset from the center O, the image forming apparatus 200 has to be controlled so that the amount d becomes smaller than in the first embodiment. Assuming that the form in which the transfer sheet P is allowed to bow is an arc, the requirement for enabling the image forming apparatus 200 to output images which are excellent in that they do not suffer from the tailing end smearing attributable to the rubbing between the trailing end portion of the transfer sheet P and photosensitive drum 205, can be given in the form of the following mathematical formulas.

In order for the image forming apparatus 200 to be no higher (smaller in numerical value) than 3.5 in image ranking in terms of the trailing end smearing of the transfer sheet P attributable to the rubbing between the trailing end portion of the transfer sheet P and photosensitive drum 205, the following is desirable:

$$0 \le d \le 3.92 + 0.0385 \times L0 - 0.000108 \times (L0-100)^2 + 5.91e^{-2} \times (L0-100)^3 \times \mathrm{Cos}(2 \times S/L0).$$

Preferably, the target value dtgt is set to satisfy the following requirement so that the image forming apparatus 200 can be made to be no higher (smaller in numerical value) than 2.0 in terms of the trailing end smearing of the transfer sheet P attributable to the rubbing between the trailing end portion of the transfer sheet P and photosensitive drum 205:

$$0 \le d \le 3.09 + 0.0305 \times L0 - 0.0000858 \times (L0-100)^2 + 4.71e^{-7} \times (L0-100)^3 \times \mathrm{Cos}(2 \times S/L0).$$

For example, in the case of an image forming apparatus which is 120 mm in L0 and 60 mm in S, d has to be no more than 4 mm, preferably, 3 mm.

As described above, the image forming apparatus in this embodiment, which can operate in the borderless printing mode, has its distance sensor 215 offset from the center C between its transfer nip T and fixation nip F. Yet, it can output images which are excellent in terms of the trailing end smearing of the transfer sheet P attributable to the rubbing between the trailing end portion of the transfer sheet P and photosensitive drum 205.

Further, the image forming apparatus 200 needs to be controlled so that it prevents the trailing end portion of the transfer sheet P from rubbing against the peripheral surface of the photosensitive drum 205, even when it is operated in the bordered printing mode, that is, the printing mode in which it outputs prints with margins. For example, if a bordered print to be made is very small in border (margin), the print will possibly suffer from the trailing end smearing attributable to the rubbing between the trailing end portion of the transfer sheet P and photosensitive drum 205. The image forming apparatus in this embodiment, however, can prevent the trailing end portion of the transfer sheet P from rubbing against the peripheral surface of its photosensitive drum 205, and therefore, can output images which are excellent in that they do not suffer from the smearing attributable to the rubbing between the trailing end portion of their transfer sheet P and the photosensitive drum 205, even when it is operated in the bordered printing mode.

Embodiment 3

The structure of the image forming apparatus in this embodiment is the same as that in the first embodiment. Here, therefore, only the differences between the first and second embodiments are described.

In the first embodiment, immediately after the fixation motor 220 begins to be controlled in speed, the image forming apparatus is controlled, with the target value dtgt for the bowing of the transfer sheet P being set to zero, so that the amount d by which the transfer sheet P bows becomes roughly the same as the target value dtgt the moment when the trailing edge of the transfer sheet P comes out of the fixation nip F. Therefore, the image forming apparatus in this embodiment can output prints which are free of the trailing end smearing attributable to the rubbing between the trailing end portion of the transfer sheet P and the peripheral surface of the photosensitive drum 205. The changes which occurred to the amount d of bowing of the transfer sheet P while the image forming apparatus was under the above-described control are shown in FIG. 5.

Figure 12:
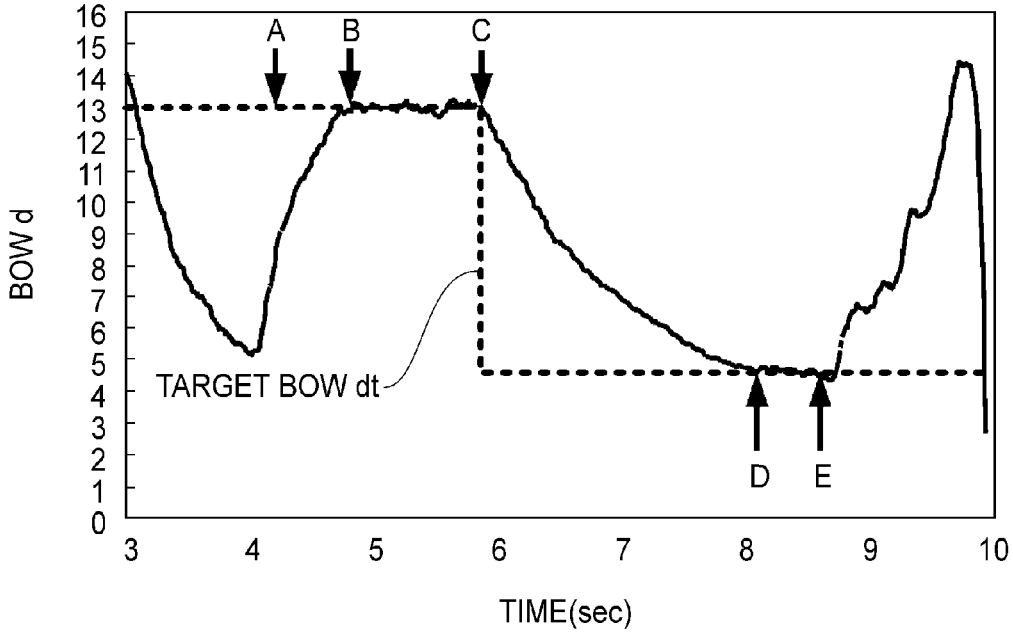
FIG. 12 is a graph which shows the relationship between the amount of the downward bow (sag) of a sheet of recording medium and the elapsed length of time.

In the third embodiment, for a preset length of time after the starting of the control, the amount d was kept larger by setting larger the target value dtgt for the bowing of the transfer sheet P. Then, the target value dtgt was set to roughly zero so that the trailing end portion of the transfer sheet P did not rub the peripheral surface of the photosensitive drum 205. FIG. 12 shows the results of the control of the image forming apparatus in this embodiment.

The image forming apparatus in this embodiment, L0 was 120 mm in the distance between the transfer nip T and fixation nip F, and 40 mm/s in process speed. Thus, in order to make the apparatus to output prints which are free of the smearing attributable to the rubbing between the trailing end portion of the transfer sheet P and the peripheral surface of the photosensitive drum 205, the amount d by which the transfer sheet P bows when the trailing edge of the transfer sheet P comes out of the transfer nip T had to be made no more than 8.5 mm (from Formula (4)), preferably, 6.8 mm (from Formula (5)).

To describe the flow of the control sequence in this embodiment with reference to FIG. 12, the speed control of the fixation motor 220 is started when the transfer sheet P enters the fixation nip F (point A in time in FIG. 12). Then, the speed of the fixation motor 220 is controlled, with the target value dgtg for the bowing of the transfer sheet P set to 13 mm. The amount d by which the transfer sheet P bows converges to the target value dtgt (13 mm) 0.5 second after the starting of the control (point B in time in FIG. 12).

Then, 1.8 seconds (point C in time in FIG. 12) after the starting of the control, that is, after the transfer sheet P moved 72 mm past the transfer nip T, the target value dtgt for the bowing of the transfer sheet P was switched to 4.6 mm, which enables the image forming apparatus to prevent the trailing end portion of the transfer sheet P from rubbing the peripheral surface of the photosensitive drum 205. Then, the control was ended (point E in time in FIG. 12) as the trailing edge of the transfer sheet P comes out of the transfer nip T after the amount d by which the transfer sheet P bowed converged to the target value dtgt.

As described above, for a preset length of time from the starting of the control, the target value dtgt was kept larger than a proper value for the image forming apparatus to prevent the trailing end portion of the transfer sheet P from rubbing the peripheral surface of the photosensitive drum 205. This control is advantageous in terms of preventing the transfer sheet P from being wrinkled. The reason for this advantage is as follows.

Right after the leading end portion of the transfer sheet P enters the fixation nip F, the transfer sheet P is unlikely to be perfectly flat, that is, it is likely to be slightly wavy in the direction parallel to the lengthwise direction of the fixation nip F. If the transfer sheet P is introduced into the fixation nip F while the leading end portion of the transfer sheet P is remaining wavy as described above, it is possible that the transfer sheet P will be wrinkled in such a manner that the lines of wrinkle are parallel to the direction of the crests and valleys of the waviness. In this embodiment, therefore, while the front half of the transfer sheet P is conveyed between the transfer nip T and fixation nip F, it is made to bow substantially downward in the direction perpendicular to the lengthwise direction of the fixation nip F, in terms of the transfer medium conveyance direction E. Thus, the transfer sheet P is rid of its waviness. In other words, this embodiment can prevent the transfer sheet P from being wrinkled by the fixation nip F.

It was also found out through the experiments carried out by the inventors of the present invention that the length of time the amount d by which the transfer sheet P was made to remain substantially bowing is desired to be no less than the length of time it takes for the pressure roller, which is the driving means of the fixing device 233, to rotate no less than one full turn.

Also in this embodiment, the image forming apparatus enabled to operate in the borderless printing mode is controlled in the amount d by which the transfer sheet P is made to bow, with the use of the distance sensor 215. That is, the apparatus was controlled so that for a preset length of time after the entrance of the transfer sheet P into the fixation nip F, the amount d by which the transfer sheet P is made to bow, remains greater than the value desirable for preventing the trailing end portion of the transfer sheet P from rubbing the peripheral surface of the photosensitive drum 205, and thereafter, the target value dtgt is set to roughly zero. Therefore, not only does the image forming apparatus prevent the trailing end portion of the transfer sheet P from rubbing the peripheral surface of the photosensitive drum 205, but also, the transfer sheet P from being wrinkled by the fixation nip F, being thereby enabled to output excellent prints.

The summary of this embodiment is as follow: The image forming apparatus has a storage means 218 (memory) in which the target values dtgt are stored. The controller 216, or the speed control section, switch the image forming apparatus in target value dtgt after the elapse of a preset length of time from the starting of the transfer of a toner image onto the sheet P of recording medium in the transfer nip T. Then, the moment when the trailing edge of the sheet P of recording medium comes out of the transfer nip T, the controller 216 begins to control the image forming apparatus in recording medium conveyance speed so that the amount d by which the sheet P bows becomes roughly zero. There are stored multiple values for the target value dtgt, in the storage means 218. Therefore, the target amount for the amount d, by which the transfer sheet P is made to bow, can be varied according to the type of the recording medium being conveyed.

Incidentally, an image forming apparatus sometime outputs a print suffering from the smearing attributable to the rubbing between the tailing end portion of the sheet P of recording medium and the peripheral surface of the photosensitive drum, even when it is operated in the bordered printing mode, that is, the mode in which a print having borders (margins) is outputted. For example, if a print which is very small in margin rubs the peripheral surface of the photosensitive drum by its trailing end portion, the print becomes unsatisfactory. The image forming apparatus in this embodiment, however, can prevent the trailing end portion of the sheet P of recording medium from rubbing the peripheral surface of the photosensitive drum. Therefore, it can output excellent images, that is, images which do not suffer from the smearing attributable to the rubbing between the sheet P of recording medium and the peripheral surface of the photosensitive drum.

Embodiment 4

Figure 13:
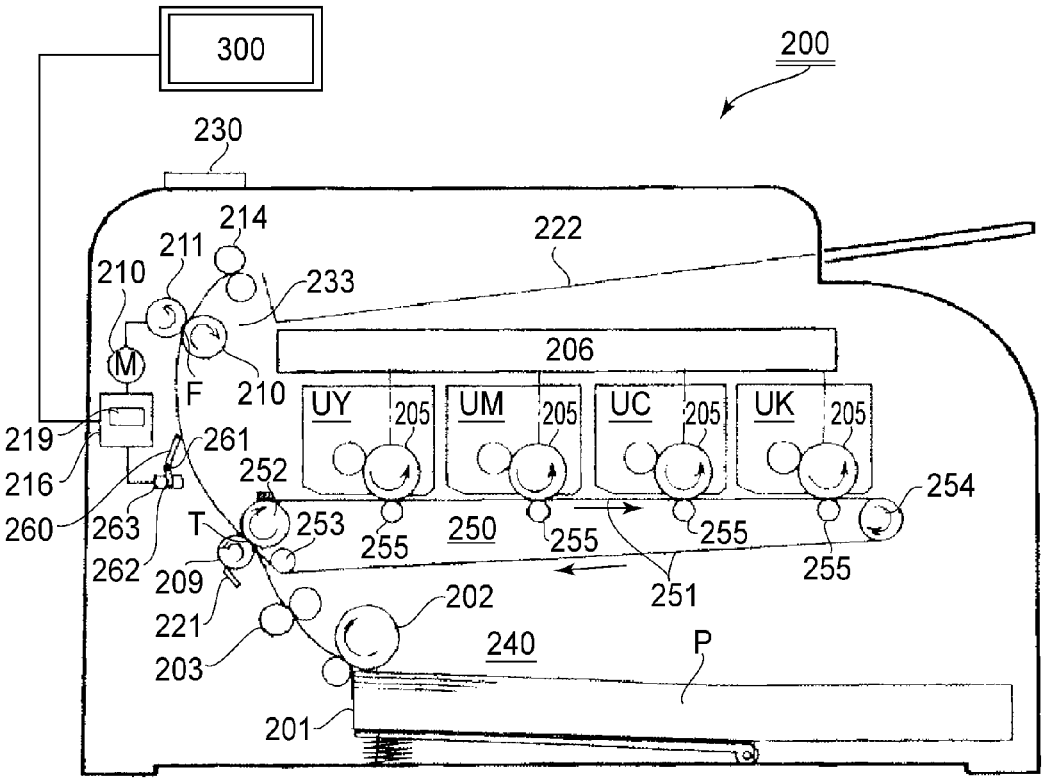
FIG. 13 is a schematic sectional view of the image forming apparatus in the fourth embodiment of the present invention, and shows the general structure of the apparatus.

FIG. 13 is a schematic sectional view of the image forming apparatus 200 in the fourth embodiment of the present invention, and shows the general structure of the apparatus 200. The image forming apparatus 200 in FIG. 13 is an electrophotographic color image forming apparatus, more specifically, a laser beam color printer. It employs multiple photosensitive members 205, and an intermediary transfer belt 251 which is circularly movable. The structural components and portions of this image forming apparatus, which are the same as those of the laser beam printer shown in FIG. 1, are given the same referential codes as those given to the counterparts of the printer shown in FIG. 1, are not going to be described in order not to repeat the same descriptions.

(1) Image Formation Stations

There are four image formation stations, that is, the first to fourth image formation stations UY, Um, UC, and UK, in the main assembly of the apparatus 200. The four image formation stations are in the form of a process cartridge, and are roughly horizontally aligned in parallel and tandem. They are the same in structure, although they are different in the color of the toner which their developing device contains. Each station is an electrophotographic image formation mechanism on its own.

That is, each station has an electrophotographic photosensitive drum 205 (as first image bearing member) and drum processing means. The drum processing means are a charge roller 207, a developing device 204, a drum cleaner 208, etc., which are similar to the charge roller 207, developing device 205, and drum cleaner 208, etc., shown in FIG. 1, although they are not shown in FIG. 13. The drum 205 in this embodiment is rotated in the counterclockwise direction indicated by an arrow mark in FIG. 12, at a preset peripheral velocity.

On the drum 205 of the first station UY, a yellow (Y) toner image is formed.

On the drum 205 of the second station UM, a magenta (M) toner image is formed.

On the drum 205 of the third station UC, a cyan (C) toner image is formed.

On the drum 205 of the fourth station UK, a black (K) toner image is formed.

There is a unit 250 under the group of the stations UY, UM, UC, and UK. The unit 250 has an intermediary transfer belt 251, which is the second image bearing member. The belt 251 is endless. It is supported and kept stretched by a driver roller 252, a follower roller 253, and a tension roller 254, and is circularly moved in the clockwise direction indicated by an arrow mark, at roughly the same velocity as the peripheral velocity of the drum 205. The drum 205 of each station U is in contact with the outward surface of the belt 251 by the downwardly facing portion of its peripheral surface. There are four primary transfer rollers 255 within the loop which the belt 251 forms. Each primary roller 255 is positioned so that it opposes the drum 205 of the corresponding station.

As the belt 251 is circularly moved, four monochromatic toner images, different in color, are transferred in layers (primary transfer) onto the outward surface of the belt 251 from the four drums 205 of the four stations U, one for one. Thus, a full-color toner image is synthetically effected on the outward surface of the belt 251, and is conveyed to the second transfer nip T by the subsequent circular movement of the belt 251. The transfer nip T is the interface between the belt 251 and a secondary transfer roller 209, and is formed by pressing the secondary transfer roller 209 against the driver roller 252, with the presence of the belt 251 between the secondary transfer roller 209 and the driver roller 252. That is, the transfer nip T is the area of contact between the belt 251 and secondary transfer roller 209.

Meanwhile, sheets P of transfer medium are fed one by one into the main assembly of the image forming apparatus 200 from the sheet feeding/conveying mechanism 240 while being separated from the rest. Then, each sheet P of transfer medium is introduced into the transfer nip T by the pair of registration rollers 203, and conveyed through the transfer nip T while remaining pinched between the secondary transfer roller 209 and belt 251. While the sheet P of transfer medium is conveyed through the transfer nip T, the full-color toner image on the belt 251 is transferred (secondary transfer) onto the transfer sheet P as if it is peeled away from the belt 251. As the transfer sheet P is moved out of the transfer nip T, it is separated from the belt 251, and is conveyed to the fixing device 233.

The fixing device 233 in this embodiment is similar to the fixing device shown in FIG. 1. That is, it is a thermal fixing device, and has a heating film and a pressure roller (which functions also as driving roller). The transfer sheet P is introduced into the fixation nip F and is conveyed through the fixation nip F while remaining pinched by the pressure roller and heating film. Thus, the unfixed full-color toner image on the transfer sheet P is subjected to the heat from the heater through the fixation film, and the pressure in the fixation nip F. As a result, the unfixed full-color toner image becomes solidly fixed to the transfer sheet P. As the transfer sheet P is conveyed out of the fixing device 233, it is conveyed through the nip of the pair of sheet conveyance rollers 214, and is discharged, as a finished print, into the delivery tray 222.

The image forming apparatus 200 in this embodiment also can be operated in the borderless printing mode, which is selectable with the use of the external apparatus 300 such as a host computer or the like which is in connection to the image forming apparatus 200, or with the use of the control panel of the apparatus 200. That is, as the printer controller 216 (control section) receives a borderless printing mode signal, it makes the apparatus 200 carry out the image formation sequence for the borderless printing mode.

Also in this embodiment, the mask for defining the area of a sheet P of transfer medium, which is to be covered with a toner image, is made larger than the sheet P so that as a toner image is transferred onto the sheet P, it extends beyond the leading, trailing, left and right edges of the sheet P by a preset width (2 mm), to yield a borderless print. That is, a toner image, which is large enough to extend beyond the leading, trailing, left, and right edges of the sheet P, is formed on the peripheral surface of the drum 205, so that as the toner image is transferred onto the sheet P of transfer medium by transferring the toner image onto the sheet P by the transfer roller 209, a borderless print is made. The toner transferred onto the peripheral surface of the transfer roller 209 from the portions of the toner image, which extended beyond the edges of the sheet P of transfer medium is removed by the cleaning blade 221.

The image forming apparatus in this embodiment is also provided with a means 260 for detecting the amount of bow of a sheet P of recording medium. This detecting means 260 is rotationally movable about the axle 261. It has a flag 262 which extends in the opposite direction from the base portion of the means 260. It detects whether or not the amount d by which the transfer sheet P is bowing is no less than a preset value, based on whether or not the optical sensor 263 is blocked by the flag 262. The output (on or off signal) of the means 260 for detecting the amount d by which the transfer sheet P is bowing is detected by a timer (clocking means); the length of time the output signal of the means 260 is on (or off) is measured by the timer.

The pressure roller 211 can be switched in speed in two or more steps by the controller 216 equipped with a speed switching means 219. Thus, the amount d by which a sheet P of recording medium is made to bow is kept constant by switching the fixation motor 220 in speed. Incidentally, the pressure roller 211 in this embodiment is switchable in speed between two values.

More concretely, while the transfer sheet P is not bowing at all, the sensor 263 is on. As the amount d by which the transfer sheet P is bowing exceeds a preset value, the flag 262 blocks the sensor 263, and therefore, the sensor 263 is turned off. Therefore, when the sensor 263 is on, the image forming apparatus 200 is reduced in the speed at which the transfer sheet P is conveyed through the fixation nip F, and as the sensor 263 is turned off, the apparatus 200 is increased in the speed at which the transfer sheet P is conveyed through the fixation nip F. Thus, the amount d by which the transfer sheet P bows between the transfer nip T and fixation nip F remains stable.

In the first embodiment, the transfer roller 209 was positioned so that it opposes the drum 205. In this embodiment, the transfer roller 209 is positioned so that it opposes the belt driving roller 252. However, the condition which causes the trailing end portion of a sheet P of recording medium to rub the peripheral surface of a photosensitive drum is the same. In other words, unless the image forming apparatus 200 in this embodiment satisfies the same requirements as those in the first embodiment, the image forming apparatus 200 in this embodiment also allows the trailing end portion of a sheet P of recording medium to rub the peripheral surface of a photosensitive drum.

In this embodiment, the target value dtgt for the amount d by which a sheet P of recording medium is made to bow downward was set to 3 mm, which was obtained from the mathematical formulas (4) and (5) for preventing the rubbing between the trailing end of a sheet P of recording medium and the peripheral surface of the photosensitive drum, assuming that the distance between the transfer nip T to fixation nip F is 120 mm. More concretely, the means 260 for detecting the amount d by which a sheet of recording medium is bowing is positioned at the center between the transfer nip T and fixation nip F. Further, the flag 262 was shaped so that as the amount of bowing of a sheet P of recording medium becomes no more than 3 mm, the flag 262 turns on the sensor 263, whereas as the amount of bowing of the sheet P of recording medium exceeds 3 mm, the flag 262 turns off the means 260.

The image forming apparatus 200 in this embodiment structured as described above was evaluated in the quality of the images formed in the borderless printing mode. The method used to evaluate the image forming apparatus 200 in this embodiment is the same as the one used to evaluate the image forming apparatus 200 in this first embodiment. The evaluation proved that the image forming apparatus 200 in this embodiment prevented the trailing end portion of a sheet P of recording medium from rubbing the peripheral surface of the photosensitive drum 205.

As described above, the image forming apparatus 200 in this embodiment was of a color image forming apparatus of the inline type, and employed an intermediary transfer belt. The amount d by which a sheet of recording medium is made to bow downward (sag) was controlled with the use of a means for detecting the amount d by which a sheet of recording medium is bowing, in such a manner that by the time when the trailing edge of the sheet of recording medium comes out of the transfer nip T, the amount d becomes virtually zero. Thus, the image forming apparatus 200 prevented the trailing end portion of a sheet of recording medium from rubbing the peripheral surface of the photosensitive drum 205, and therefore, yielded excellent images.

Incidentally, an image forming apparatus sometimes outputs a print suffering from the smearing attributable to the rubbing between the tailing end portion of a sheet of recording medium and the peripheral surface of the photosensitive drum, even when it is operated in the bordered printing mode, that is, the printing mode in which a print having margins is outputted. For example, if a print which is very small in margin rubs the peripheral surface of the photosensitive drum by its trailing end portion, the print becomes unsatisfactory. Therefore, an image forming apparatus has to be enabled to prevent the trailing end portion of a sheet of recording medium from rubbing the peripheral surface of a photosensitive drum, even when it is operated in the bordered printing mode. The image forming apparatus in this embodiment, however, can prevent the trailing end portion of a sheet of recording medium from rubbing the peripheral surface of the photosensitive drum. Therefore, it can output excellent images, that is, images which do not suffer from the smearing attributable to the rubbing between the sheet P of recording medium and the peripheral surface of the photosensitive drum, even when the image forming apparatus 200 is operated in the bordered printing mode.

Embodiment 5

Figure 14:
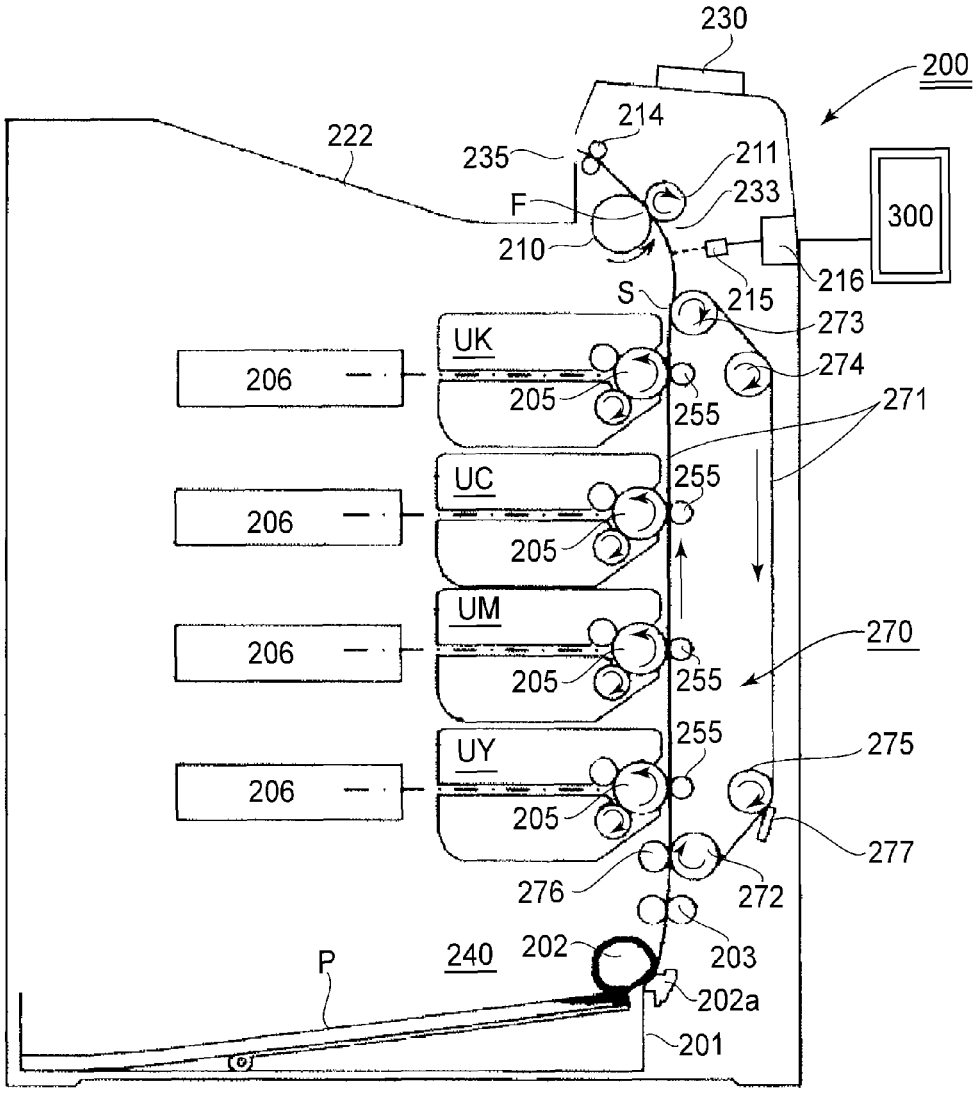
FIG. 14 is a schematic sectional view of the image forming apparatus in the fifth embodiment of the present invention, and shows the general structure of the apparatus.

FIG. 14 is a schematic sectional view of the image forming apparatus 200 in this embodiment of the present invention, and shows the general structure of the apparatus 200. The image forming apparatus 200 in FIG. 14 is an electrophotographic color image forming apparatus, more specifically, a laser beam color printer. It employs a transfer medium conveyance belt (recording medium conveyance belt) which conveys a sheet P of transfer medium by electrostatically adhering the sheet P to itself. The structural components and portions of this image forming apparatus, which are the same as those of the color laser beam printer shown in FIG. 13, are given the same referential codes as those given to the counterparts of the printer shown in FIG. 13, are not going to be described in order not to repeat the same descriptions.

This apparatus 200 has four color image formation stations, that is, the first to fourth image formation stations UY, UM, UC and UK, in the main assembly of the apparatus 200. The color image formation stations are in the form of a process cartridge, and are roughly vertically aligned in a single line, in parallel and tandem. The drum 205 in each station in this embodiment is rotated in the counterclockwise direction indicated by an arrow mark in FIG. 14, at a peripheral velocity (process speed) of 40 mm/s.

The apparatus 200 is provided with a belt unit 270 which has the endless transfer medium conveyance belt (recording medium conveyance belt) which conveys vertically upward a sheet P of transfer medium from the bottom end portion of the main assembly of the apparatus 200 by adhering the sheet P to itself. The belt unit 270 is positioned so that the drum exposing side of each station U faces the belt unit 270. It is supported and kept stretched by the first to fourth rollers 272-275, which are parallel to each other and belong to the first, second, third, and fourth stations UY, UM, UC and UK, respectively. It is circularly moved in the clockwise direction indicated by an arrow mark in FIG. 14 at the same velocity as the peripheral velocity of each drum 205.

The drum 205 in each station U is in contact with the outward surface of the portion of the belt 271 between the first roller 272 and second roller 273. There are four primary transfer rollers 255 within the loop which the belt 271 forms. Each primary roller 255 is positioned so that it opposes the drum 205 of the corresponding station. The apparatus 200 is also provided with an adhesion roller 276, which is kept pressed against the first roller 272, with the presence of the belt 271 between the adhesion roller 276 and first roller 272. The area of contact between the belt 271 and adhesion roller 276 is the recording medium adhesion nip.

Sheets P of transfer medium are fed one by one, while being separated from the rest, into the main assembly of the image forming apparatus 200 from the sheet feeding/conveying mechanism 240, which is below the first station UY. Then, each sheet P of transfer medium is introduced into the transfer medium adhesion nip by a pair of registration roller 203 with a preset control timing, and is electrostatically adhered to the outward surface of the belt 271. Then, the transfer sheet P is conveyed upward by the circular movement of the belt 271, sequentially through the transfer nips of the first to fourth stations UY, UM, UC and UK. While the transfer sheet P is conveyed through the transfer nips by the belt 271, yellow (Y), magenta (M), cyan (C) and black (K) monochromatic toner images are sequentially transferred in layers onto the transfer sheet P of the belt 271 from the four drums 205 in the four stations, one for one. Consequently, a full-color toner image is synthetically effected on the transfer sheet P.

After the formation of a full-color toner image on the transfer sheet P, the sheet P is conveyed to where the belt 217 wraps around the second roller 273, being thereby separated from the belt 217 by the curvature of the roller 273. Then, the sheet P is conveyed to the fixing device 233.

The fixing device 233 is similar to the fixing devices in FIGS. 1 and 13. That is, it is a thermal fixing device which employs a heating film, and a pressure roller. More concretely, a sheet P of transfer medium is introduced into the fixation nip F of the device 233, and is conveyed through the fixation nip F, remaining pinched between the fixation film and pressure roller. While the sheet P is conveyed through the fixation nip F, the unfixed full-color toner image on the transfer sheet P is fixed to the sheet P by the heat applied from the heater through the fixation film 210, and the pressure in the fixation nip F. After being conveyed out of the fixing device 233, the sheet P is discharged, as a finished print, through the outlet 235 onto the delivery tray 222, which is outside the main assembly of the apparatus 200.

The image forming apparatus 200 in this embodiment also can operate in the borderless printing mode, which is selectable with the use of the external apparatus 300 such as a host computer or the like which is in connection to the image forming apparatus 200, or with the use of the control panel 230 of the apparatus 200. That is, as the printer controller 216 (control section) receives a borderless printing mode signal, it makes the apparatus 200 carry out the image formation sequence for the borderless printing mode.

Also in this embodiment, a toner image is formed on the peripheral surface of the drum 205 so that it is larger than a sheet P of recording medium (transfer medium), by a preset amount large enough to make the image extend beyond the leading, trailing, right, and left edges of the sheet P by a preset distance (2 mm) as the toner image is transferred onto the sheet P from the belt 251. The thus formed toner image on the peripheral surface of the drum 205 is transferred onto the sheet P of transfer medium remaining adhered to the belt 271, by the transfer roller 255, which is on the inward side of the belt loop and opposes the drum 205, to which bias is being applied. As this oversized toner image on the photosensitive drum 205, the toner from the extended portions of the toner image on the drum 205 is partially transferred onto the belt 271.

The transferred toner on the belt 271 is removed by a cleaning blade 277, which is in contact with the belt 271 at the location of the fourth roller 275.

The image forming apparatus 200 in this embodiment is also controlled in such a manner that while a sheet P of transfer medium is conveyed between the transfer nip of the station BK and the fixation nip F, it bows downward by a preset amount. In this embodiment, the amount d by which a sheet P of transfer medium is made to bow downward is as the amount of bowing of a sheet P of transfer medium relative to the straight line between the point S of separation of transfer medium from the belt 271, and the fixation nip F.

The image forming apparatus 200 in this embodiment also has an optical distance sensor 215, which is similar to the one in the first embodiment. The sensor 215 is positioned so that it is on the backside of a sheet P of transfer medium, and also, roughly at the center between the point S of separation and the fixation nip F, that is, where the amount d of bow of the transfer sheet becomes largest. Also in this embodiment, the image forming apparatus 200 is controlled, with the use of the optical distance sensor 215, in the speed at which a sheet P of recording medium is conveyed through the fixation nip F, so that the amount d of bow of transfer medium remains constant. The method used for the control is the same as the one used in the first embodiment.

Figure 15:
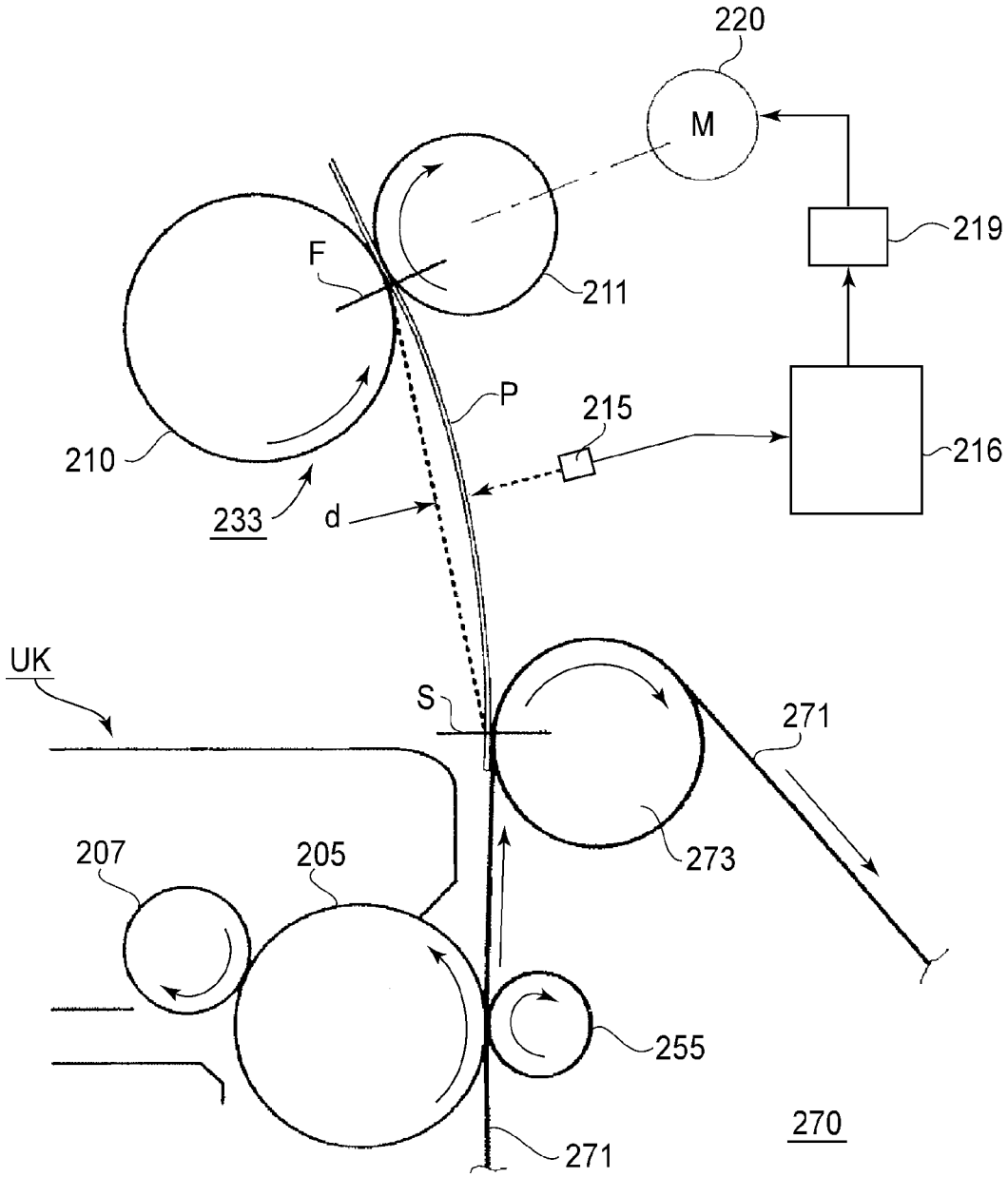
FIG. 15 is an enlarged schematic sectional view of a part of FIG. 14.
Figure 16:
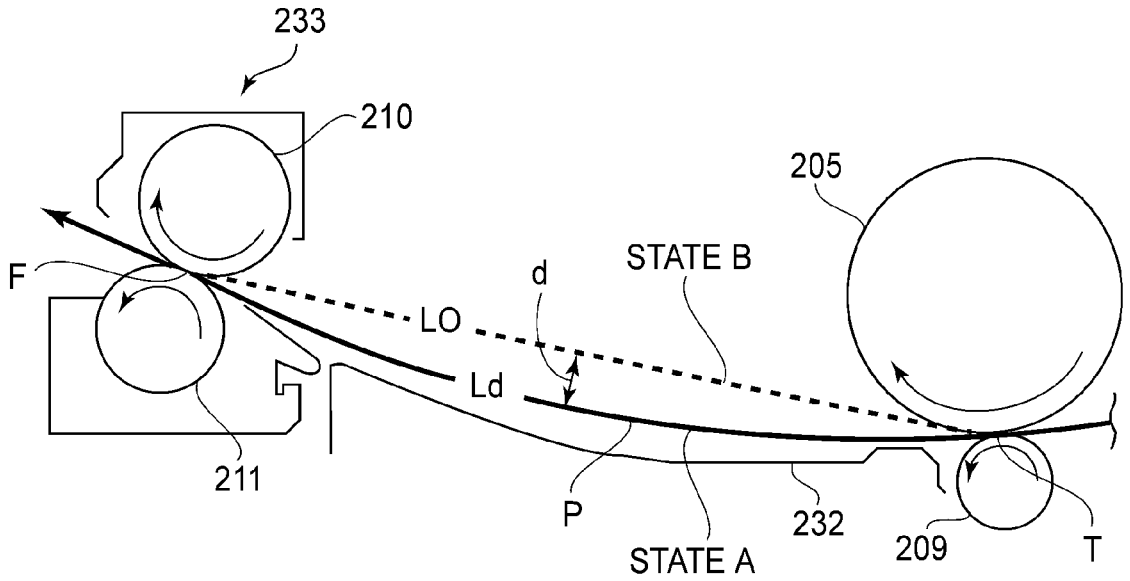
FIG. 16 is a drawing which shows the posture of a sheet of recording medium, between the transfer nip and fixation nip.

FIG. 15 is an enlarged schematic sectional view of the portion of the image forming apparatus 200, which is between the point S of separation and the fixation nip F, in FIG. 14. In this embodiment, the soiling of the trailing end surface (one of surfaces which resulted as transfer medium was cut to specific size, and is perpendicular to primary surfaces), and/or back surface of the transfer sheet P, by toner, can be prevented by controlling the image forming apparatus 200 so that the amount d by which a sheet P of transfer medium bows between the point S of separation at which a sheet P of transfer medium separates from the belt 271, and the fixation nip F, becomes roughly zero.

Next, referring to FIG. 15, the reason why the control in this embodiment works is described. A sheet P of transfer medium is adhered to the belt 271, and then, is conveyed by the belt 271, at roughly the same speed as the speed of the surface of the belt 271. If the amount d by which the transfer sheet P bows is substantial, the transfer sheet conveyance force which the trailing end portion of the transfer sheet P receives from the belt 271 becomes smaller as the trailing edge of the transfer sheet P is moved past the point S of the transfer sheet separation. Therefore, as the trailing edge of the transfer sheet P is moved past the point S of the transfer sheet separation, the speed of the trailing end portion of the transfer sheet becomes slower than that of the surface speed of the belt 271.

Thus, the trailing end portion of the transfer sheet P is rubbed by the belt 271 while the trailing end portion of the transfer sheet P reduces in speed. When the image forming apparatus 200 is operated in the borderless printing mode, the surface of the belt 271 has the toner transferred onto the belt 271 from the fringe portions of the toner image formed slightly larger than necessary for the borderless printing mode. Therefore, as the trailing end portion of the transfer sheet P is rubbed by the belt 271, its back surface is soiled by the toner on the belt 271, and/or the trailing end surface (which results as transfer medium is cut to specific size, and is perpendicular to primary surfaces of transfer sheet) is soiled by the toner on the belt 271.

The contents of the description of this embodiment given above are virtually the same as those of the description of the first embodiment, except that in the description of this embodiment, the transfer nip T has been replaced with the point S of transfer sheet separation.

The image forming apparatus in this embodiment also was evaluated in image quality by the experiments in which the amount d by which was made to bow was varied. The results of the experiments showed that there was a strong relationship between the amount d and the amount of soiling of the trailing end surface of a sheet P of transfer medium, and also, between the amount d and the amount of soiling of the back surface of a sheet P of transfer medium. Thus, the desirability for preventing the soiling of the trailing end surface of a sheet P of transfer medium, and the soiling of the back surface of the trailing end portion of a sheet P of transfer medium can be expressed in the form of the following mathematical formulas, which are the same as those in the first embodiment:

$$0 \le d \le 3.92+0.0385\times L0-0.000108\times(L0-100)^2+5.91e^{-7}\times(L0-100)^3,$$

$$\text{preferably, } 0 \le d \le 3.09+0.0305\times L0-0.0000858\times(L0-100)^2+4.71e^{-7}\times(L0-100)^3.$$

d: amount of bow of transfer sheet P when trailing edge of transfer sheet P comes out of transfer nip T (point S of separation)

L0: distance from transfer nip T (point S of separation) to fixation nip F.

As described above, in this embodiment, the image forming apparatus which is of the so-called inline type, employs the transfer medium conveyance belt, and can also be operated in the borderless printing mode, is controlled in the amount d by which a sheet P of transfer medium is made to bow, with the use of a means for detecting the amount d, so that the amount d becomes virtually zero when the trailing edge of the transfer sheet P comes out of the transfer nip T (point of S of separation). Therefore, the image forming apparatus can prevent the trailing end surface of a sheet P of transfer medium and the back surface of the trailing end of a sheet P of transfer medium from being soiled by toner. Therefore, it can output excellent prints.

Further, even if the image forming apparatus 200 is operated in the bordered printing mode, that is, the printing mode for outputting a print with margins, the tailing end portion of a sheet of transfer medium has to be prevented from rubbing the peripheral surface of the photosensitive drum, because a print which suffers from the soiling of its trailing end portion by toner is sometimes outputted even if the image forming apparatus 200 is operated in the bordered printing mode. For example, if the trailing end portion of a sheet of transfer medium rubs the peripheral surface of the photosensitive drum while a print which is very narrow in margin is made, the trailing end portion of the print may suffer from soiling by toner. The image forming apparatus 200 in this embodiment, however, is controlled so that it prevents the trailing end portion of a sheet of transfer medium from rubbing the peripheral surface of the photosensitive drum. Therefore, it can output images which are excellent in that they do not suffer from the soiling of their trailing end portions by toner, which is attributable to the rubbing between the trailing end portion of a sheet of transfer medium and the peripheral surface of the photosensitive drum.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 094021/2011 filed Apr. 20, 2011, which is hereby incorporated by reference.

What is claimed is:

1. An image forming apparatus comprising:

a rotatable image carrying member for carrying a toner image;

a rotatable transfer member cooperative with said image carrying member to form a transfer nip for nipping and feeding a recording material while transferring the toner image onto the recording material;

a fixing unit having a fixing nip for nipping and feeding the recording material discharged from the transfer nip while fixing the toner image transferred onto the recording material;

a bowing amount measuring unit for measuring a bowing amount of the recording material which is fed while being nipped by the transfer nip and the fixing nip;

a storing portion storing a target bowing amount; and a speed controller for controlling a feeding speed of the recording material by the fixing nip, wherein said storing portion stores a plurality of target bowing amounts, which are selectable depending on kinds of the recording material, and wherein said speed controller is capable of controlling the feeding speed in the fixing nip so that a result of the measurement of the bowing amount measuring unit indicates the target bowing amount, thereafter changing the target bowing amount, and then controls the feeding speed in the fixing nip so that the bowing amount is substantially zero at the time when a trailing edge of the recording material leaves the transfer nip.

2. An apparatus according to claim 1, wherein said apparatus is operable in a borderless printing mode in which the toner image is formed on an area corresponding to an outside of the recording material and is transferred onto the recording material to an edge of the recording material, and wherein said speed controller effects the control.

3. An apparatus according to claim 1, wherein said bowing amount measuring unit is of a non-contact type.

4. An apparatus according to claim 1, wherein said image carrying member is a rotatable photosensitive member.

5. An apparatus according to claim 1, wherein said image carrying member includes a rotatable intermediary transfer belt, wherein the toner image is transferred from said image carrying member onto said intermediary transfer belt, and then transferred from said intermediary transfer belt onto the recording material.

6. An apparatus according to claim 4, wherein said apparatus comprises a plurality of such photosensitive members, and toner images are transferred onto the recording material which is being fed by a feeding belt.

7. An apparatus according to claim 1, wherein said bowing amount measuring unit includes a light emitting portion for emitting light toward the recording material, and a light receiving portion for receiving the light reflected by the recording material, and measures a distance between said bowing amount measuring unit and the recording material on the basis of a detection result of said light receiving portion.

8. An apparatus according to claim 7, wherein said bowing amount measuring unit is disposed at a position closer to the fixing nip than to the transfer nip in the recording material feeding direction.

9. An apparatus according to claim 1, wherein when a borderless printing mode operation is carried out, the feeding speed of the recording material at the time when a trailing edge of the recording material leaves the transfer nip is substantially the same as a moving speed of said image bearing member.

10. An image forming apparatus comprising a rotatable image carrying member for carrying a toner image;

a rotatable transfer member cooperative with said image carrying member to form a transfer nip for nipping and feeding a recording material while transferring the toner image onto the recording material;

a fixing unit having a fixing nip for nipping and feeding the recording material discharged from the transfer nip while fixing the toner image transferred onto the recording material;

a measuring unit, provided at a position facing the recording material bridging between the transfer nip and the fixing nip, for measuring a distance between said measuring unit and the recording material; and a speed controller for controlling a feeding speed of the recording material by the fixing nip, wherein said speed controller starts acceleration of the feeding speed in the fixing nip so that the distance measured by said measuring unit approaches a predetermined target value before the time at which a trailing edge of the recording material leaves the transfer nip.

11. An apparatus according to claim 10, wherein said speed controller is capable of controlling the feeding speed in the fixing nip so that bowing of the recording material between the transfer nip and the fixing nip is eliminated at the time when the trailing edge of the recording material leaves the transfer nip.

12. An apparatus according to claim 10, wherein said apparatus is operable in a borderless printing mode in which the toner image is formed on an area corresponding to an outside of the recording material and is transferred onto the recording material to an edge of the recording material, and wherein said speed controller effects the control.

13. An apparatus according to claim 10, wherein said image carrying member is a rotatable photosensitive member.

14. An apparatus according to claim 10, wherein said image carrying member includes a rotatable intermediary transfer belt, wherein the toner image is transferred from said photosensitive member image carrying member onto said intermediary transfer belt, and then transferred from said intermediary transfer belt onto the recording material.

15. An apparatus according to claim 13, wherein said apparatus comprises a plurality of such photosensitive members, and toner images are transferred onto the recording material which is being fed by a feeding belt.

16. An apparatus according to claim 10, wherein said bowing amount measuring unit includes a light emitting portion for emitting light toward the recording material, and a light receiving portion for receiving the light reflected by the recording material, and measures a distance between said bowing amount measuring unit and the recording material on the basis of a detection result of said light receiving portion.

17. An apparatus according to claim 10, wherein said bowing amount measuring unit is disposed at a position closer to the fixing nip than to the transfer nip in the recording material feeding direction.

18. An apparatus according to claim 10, wherein when a borderless printing mode operation is carried out, the feeding speed of the recording material at the time when a trailing edge of the recording material leaving the transfer nip is substantially the same as a moving speed of said image bearing member.

* * * * *